US005600897A

United States Patent [19]

Sollinger et al.

[11] Patent Number: 5,600,897

[45] Date of Patent: Feb. 11, 1997

[54] MIXED DRYER SECTION INCLUDING SINGLE-TIER AND DOUBLE-TIER DRYING GROUPS WITH AUTOMATIC ROPELESS THREADING

[75] Inventors: Hans-Peter Sollinger, Heidenheim; Gerhard Kotitschke, Steinheim; Hans J. Wulz; Peter Kahl, both of Heidenheim; Wolfgang Mueller, Giengen, all of Germany

[73] Assignee: J.M. Voith GmbH, Germany

[21] Appl. No.: 151,255

[22] Filed: Nov. 12, 1993

Related U.S. Application Data

[63] Continuation-in-part of Ser. No. 102,766, Aug. 6, 1993, abandoned.

[30] Foreign Application Priority Data

Aug. 25, 1993 [DE] Germany ..... 43 28 554.6

[51] Int. Cl.[6] ..... D06F 58/00; F26B 11/02

[52] U.S. Cl. ..... 34/115; 34/117; 34/646; 34/120

[58] Field of Search ..... 34/114, 115, 116, 34/117, 120, 646, 664

[56] References Cited

U.S. PATENT DOCUMENTS

| | | | |
|---|---|---|---|
| 4,022,366 | 5/1977 | Rooney | 162/286 |
| 4,485,567 | 12/1984 | Ely | 34/115 |
| 4,876,803 | 10/1989 | Wedel | 34/117 |
| 4,918,836 | 4/1990 | Wedel . | |
| 4,934,067 | 6/1990 | Wedel . | |
| 4,945,655 | 8/1990 | Wedel . | |
| 4,972,608 | 11/1990 | Ilvespää . | |
| 4,986,009 | 1/1991 | Haesnner et al. . | |
| 5,050,317 | 9/1991 | Kade | 34/117 |
| 5,144,758 | 9/1992 | Skaugen et al. . | |
| 5,146,696 | 9/1992 | Mayer et al. . | |
| 5,177,880 | 1/1993 | Preisetanz et al. | 34/117 |
| 5,184,408 | 2/1993 | Kotitschke et al. . | |
| 5,232,554 | 8/1993 | Kotitschke | 34/117 |
| 5,269,074 | 12/1993 | Sims et al. . | |
| 5,311,672 | 5/1994 | Kotitschke et al. . | |

*Primary Examiner*—Henry A. Bennett
*Assistant Examiner*—Susanne C. Tinker
*Attorney, Agent, or Firm*—Ostrolenk, Faber, Gerb & Soffen, LLP

[57] ABSTRACT

In the initial region of the dryer section at least one of the dryer groups (23) is developed as a single-felt dryer group in which a single endless felt (F) and the web (9) travel alternately over cylinders (73) and guide suction rolls (73'). In the final region of the dryer section there is present at least one double-felt dryer group (24) in which a web (9) travels alternately over lower (74) and upper (74') cylinders. The single-felt group (23) has an automatic ropeless tail guide device (76, 79) for the threading of the so-called tail. In the double-felt dryer group (24) an automatic ropeless tail guide device (77, 78) is also present.

70 Claims, 14 Drawing Sheets

OF
UF
F
9
S
11
12
13
14
15
16
17
21
22
23
24
25
51
51'
52
52'
53
53'
54
54'
55
55'
56
56'
57
57'
58
59
71
71'
72
72'
73
73'
74
74'
75
75'

-•- SC Grades 46-64g/m2 Speed Range 1200-1400m/min

-•- LWC Grades 30-50g/m2 Speed Range 1300-1500m/min

-▪- Copy-Grades ϕ 75 g/m2 Speed Range 1100 - 1300 m/min

MIXED DRYER SECTION INCLUDING SINGLE-TIER AND DOUBLE-TIER DRYING GROUPS WITH AUTOMATIC ROPELESS THREADING

BACKGROUND OF THE INVENTION

This is a continuation-in-part of application Ser. No. 08/102,766 filed Aug. 6, 1993, now abandoned.

The present invention relates to a dryer section for the drying of traveling web, preferably as part of a paper manufacturing machine.

The invention relates to a dryer section having a mix of single-tier and double-tier dryer groups as known, for example, from U.S. Pat. No. 5,232,554 the contents of which are incorporated by reference herein. Such a dryer section is divided into a plurality of successive dryer groups. Each of these dryer groups comprises a plurality of heatable dryer cylinders which come into contact with the web and which are coupled to a (preferably) common drive. The art distinguishes between double-felt (double-tier) and single-felt (single-tier) dryer groups. A single-felt dryer group has only a single endless felt (or a single endless wire). This felt travels together with the web alternately over the drying cylinders and guide or transfer rolls that are preferably designed as suction rolls and which are located between the drying cylinders. Such single-felt dryer groups are customarily arranged at the starting portion of the dryer section to which the web to be dried is fed in a condition in which the web is still relatively wet (solids content: about 35–55%, depending inter alia on the paper grade and machine speed). On the other hand, one or more double-felt dryer groups are customarily provided in the final region of the dryer section. Each of these dryer groups has an upper row of cylinders and a lower row of cylinders, the web travelling alternately over the upper and lower cylinders. The one or more double-felt dryer groups may be arranged directly behind a single-felt dryer group. As an alternative, an additional device (e.g. a size press or an intermediate calender) may be interposed.

Prior art drying sections deploying a mix of single and double-tier dryer groups (hereinafter "mixed drying section") are essentially of two types. In accordance with a first type, the dryer cylinders belonging to the single-tier group or groups constitute a relatively small portion, e.g. about 20% of the total drying surface traversed by the paper web through the entire drying section. In other words, about 80% of the total drying surface is comprised of the dryer cylinders in the double-tier dryer groups.

In the second type of a mixed drying section, substantially most of the total drying surface traversed by the paper web, i.e. more than about 75%, is comprised of the surfaces of the dryer cylinders which belong to the single-tier dryer groups. The remaining 25% is located in the double-tier drying cylinders. In other words, prior art mixed drying sections either are overwhelmingly single-tier or overwhelmingly double-tier. The prior art has not focused attention on the question whether there is an optimal mix that should be provided between the number of single-tier drying cylinders and double-tier drying cylinders and, if so, the precise number of cylinders of each type which should be provided.

SUMMARY OF THE INVENTION

One aspect of the present invention is concerned with the precise ratio of single-tier and double-tier drying cylinders that are to be provided in a drying section. The inventors herein reject the prior art conventional wisdom which provides too few single-tier drying cylinders, since that approach ignores problems of runnability—too many paper breaks—and greater difficulty in threading. On the other hand, the inventors discovered that configuring a dryer section entirely of single-tier dryer groups, or even overwhelmingly of single-tier groups, ignores significant advantages provided by double-tier dryer groups. Advantages of double-tier dryer groups include: ease of providing a tail cutter function; avoidance of paper bursting at certain dryness levels; achieving shorter building lengths; assuring no felt or fabric tearing and significantly reduced fabric wear; lower machine fabrication costs as compared to a total single-tier or an overwhelmingly single-tier construction; lower operating costs (steam expenditures and the like) than with total single-tier; improved overall paper quality; and enhanced visibility and control of the open draws of the paper.

Another aspect of the present invention is concerned with the problem of threading of the web to be dried into the dryer section. As is known, the following is provided for this purpose. The web which is formed and mechanically dewatered in the initial part of the paper manufacturing machine travels during the starting (threading) phase at full operating speed, but temporarily only up to the end of the press section or up to the first dryer cylinder of the dryer section. From there, it passes downward into a broke pulper. A narrow edge strip, referred hereinbelow as a "striplet" or "tail" is now separated from the web. It is passed first of all through the single-felt dryer group or groups (generally several are present). It is known that this can be done without the aid of ropes. In other words, an automatic ropeless tail guide device, i.e., a tail threading device, is present. For example, the tail is detached from the individual cylinders by means of a scraper which is combined with an air-blow nozzle. Furthermore, special edge suction chambers are provided in the transfer suction rolls, a relatively high vacuum being produced in said chambers during the tail threading process, independently of the other part of the guide suction roll.

In contrast, in accordance with Federal Republic of Germany 4037661 (which is an equivalent to said U.S. Pat. No. 5,232,554), a rope guide is provided for the threading of the tail in the subsequently located double-felt dryer group or groups. This arrangement has disadvantages. It can cause operational disturbances. The tail can slip off the rope. Further, the tail is not guided with sufficient precision. Tearing of the rope is also possible. It is therefore desirable to completely avoid rope guides in the entire dryer section of modern paper manufacturing machines. This is particularly true at the increasingly greater operating speeds encountered nowadays (on the order of magnitude of 1500 to 2500 m/min).

In order to achieve this object, an automatic ropeless tail guide device is provided in accordance with the invention in the double-felt dryer group or groups. Examples of parts of different constructions suitable for this are described in the following publications:

Federal Republic of Germany Patent 1 245 278;

Federal Republic of Germany Utility Model 8 914 079; and

Federal Republic of Germany Utility Model 9 109 313.

Experiments have shown that the reliability of pneumatically acting parts is less than satisfactory when the solids content of the web is still relatively low. Above a certain solids content and taking into account other factors, and depending on the paper grade and other parameters, however, these pneumatically acting parts operate well.

The inventors herein have studied the problems encountered in transferring a paper web from a single-tier to a double-tier dryer group and the operational difficulties encountered in threading a paper web through a double-tier dryer group and have found that an optimal transfer from a single-tier dryer group to the double-tier dryer group(s) depends on various parameters including: paper grade; stiffness of the paper web, particularly of the transfer tail; strength of the paper web, particularly of the transfer tail; dryness, i.e., solids content, of the paper web; operating speeds; basis weight of the paper web; desired paper properties in the final paper product; and runnability. The results will be discussed in detail later, in connection with a transfer point table presented in the Detailed Description section of the instant specification.

For rebuilds, costs and other considerations should be taken into account. One consideration is machine down time during a machine rebuild. It should be as short as possible, to have the least impact on paper production. Consonant with this objective, only one or perhaps two groups of an old double-tier machine might be converted to single-tier. The desire to keep the down time as short as possible might militate in favor of selecting a transfer point low in the range of possible values, or at the point between the first possible transfer point and the optimal transfer point, shown in the aforementioned transfer point table.

According to the invention, with some of the paper grades the transfer of the paper web into the double-felt dryer groups should occur at a point where the paper web has already traversed about 30–60% of the paper web contacting surface of the entire drying section. For example, a drying section including a total of 40 drying cylinders of same diameters, of which 21 are in the single-tier section and 19 in the double-tier section, meets the condition since, at the end of the single-tier dryer groups, the paper web will have traversed more than 50% of the total surface of all the drying cylinders.

In order to reliably automatically thread the paper web from the single-tier groups to and through the open draws of the double-tier groups the invention relies on two advantageous factors. First, with the conditions set forth above, the paper web develops a stiffness and firmness that is high enough for threading purposes. Second, again with the conditions set forth above, the paper web will not tend to adhere to the surface of the drying cylinders of the double-tier group or groups because the adhesion force decreases after the wet web has passed approximately 20–30% of the web contacting surface of the dryer section. By operating in accordance with the invention, the paper web is in the double-tier group(s) at a state where its adhesion to the drying cylinders is low enough to assure both good runnability and reliable automatic (ropeless) tail threading.

By constructing the drying section to include a mix of single and double-tier groups, the invention significantly shortens the overall length of the drying section, resulting in savings in machine and building costs, compared with a total single-tier configuration. The invention further obtains an optimal and prompt transfer point for the paper web between the single and double dryer groups.

In column 7, lines 10–40 of U.S. Pat. No. 5,232,554 measures are described for further conducting the oncoming tail in the known dryer section within the region of the end of the single-felt dryer group, not into the double-felt dryer group but rather temporarily into the cellar or other locations or receiving bins associated with the paper machine. Only after stable travel of the tail through the single-felt dryer group or groups has been obtained is the tail then conducted further into the double-felt dryer group or groups. The contents of U.S. Pat. No. 5,232,554 are incorporated by reference herein.

Another aspect of the invention concerns advantageous arrangements of the cylinders and felt guide rolls in the transition region between the last single-felt dryer group and the directly or indirectly following double-felt dryer group. It is particularly favorable if the web passes substantially downward through the place of separation between the two dryer groups.

Still another aspect of the invention is concerned with the problem of the removal of broke, which occasionally is produced in the event of a tear in the paper web. This task, which can never be entirely excluded, is present, in particular, in the initial region of the dryer section, i.e. in the region of the single-felt dryer groups. It is best if all single-felt dryer groups are felted on top. In such a case, the paper broke can simply fall downward under the force of gravity, in particular with arrangement of the cylinders in horizontal rows, as generally customary.

If, however, in order to obtain the most uniform possible properties on both sides of the finished web of paper, it is desired that both sides of the web of paper alternately contact the dryer cylinders, not only in the double-felt dryer group but also in the region of the single-felt dryer groups, then an arrangement of the cylinders in vertical or V-shaped rows is particularly advantageous. In this connection, reference is made to U.S. Pat. Nos. 5,050,317 and 5,177,880, the contents of which are incorporated by reference herein. The latter describes inter alia a dryer-section configuration having a plurality of V-shaped dryer groups felted on top and having two bottom-felted dryer groups in the shape of a V, and arranged to provide an optional gap that can be opened for the removal of broke between the lowermost cylinders of these two dryer groups.

If the above-mentioned transfer rolls required in the single-felt dryer group are designed as suction rolls, they can be provided with an inner stationary suction box which can also serve for defining a desired suction zone for threading. However, a construction is preferred in which the inside of the transfer suction rolls is free of stationary inserts. Furthermore, a hollow journal serving for the drawing-off of air is not necessary in order to provide a vacuum inside the roll. Rather, an external suction box is provided (for example, in the pocket between two adjacent dryer cylinders).

A final aspect of the invention is concerned with the problem of the height above a horizontal reference plane at which the axes of rotation of the cylinders and/or guide rolls of the single-felt dryer group or groups are advantageously arranged, for instance with respect to the required free evaporation path for the paper web between two cylinders. Another factor is the arrangement of these axes of rotation relative to the planes in which the axes of rotation of the cylinders of the following double-felt dryer group lie.

It is common to all the various embodiments of the invention that at least one double-felt dryer group is always present in the region of the end of the dryer section. The following advantages (some already mentioned) result from this:

1. Uniform quality of the paper, particularly approximately equal properties of the surface on both sides of the paper, which uniform quality is also obtained in the cross machine direction, obtaining improved printability and reduction of curl tendencies in comparison to paper produced with a total single-tier configuration;
2. Even if a very high final solids content is desired (on the order of 98%), there is no danger of tearing (or breaking) of the paper web since longitudinal stresses are relieved in the double-felt group;

3. The tail cutter required at the end of the dryer section can be readily arranged in the traditional manner in the double-felt dryer group;
4. No rope guide for the pulling-in of the tail is required at any place in the entire dryer section; and
5. Wear of the felts (sometimes observed in the end region of known dryer sections which have exclusively single-felt dryer groups) is avoided by the presence of the double-felt dryer groups.

Other features and advantages of the present invention will become apparent from the following description of the invention which refers to the accompanying drawings.

DETAILED DESCRIPTION OF THE INVENTION

Figures 1, 2:
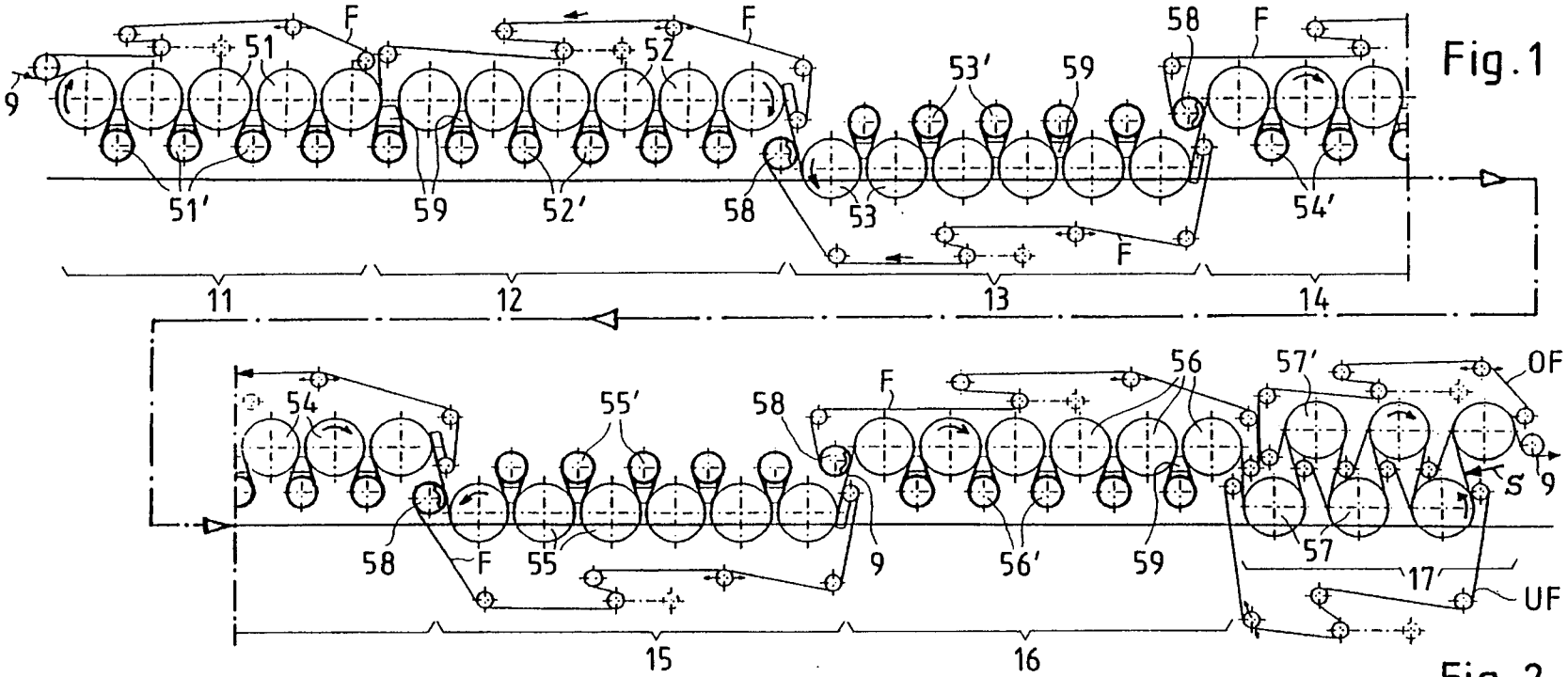
FIGS. 1 to 4 show diagrammatic side views of several different dryer section having a plurality of single-felt dryer groups and at least one subsequent double-felt dryer group.

The dryer section shown in FIG. 1 has located first in the path of the paper web six single-felt dryer groups 11–16, arranged one behind the other. Each of these dryer groups has a single endless felt F. For example, in the first dryer group 11, the felt F travels together with the web 9 alternately over dryer cylinders 51 and guide suction rolls 51'. In the first two dryer groups 11 and 12, as well as in the fourth and sixth dryer groups 14 and 16, the bottom of the web comes in contact with the cylinders; Accordingly, the dryer cylinders 51, 52, 54 and 56 lie in this embodiment above the corresponding guide suction rolls 51', 52', 54' and 56', respectively. The cylinders are in this case "top-felted". This is different in the third dryer group 13 and in the fifth dryer group 18. Here the cylinders 53, 55 contact the top side of the web. They are therefore "bottom-felted" and lie below the corresponding guide suction rolls 53', 55'. Accordingly, the paper web transfer regions between the dryer groups 12 to 16 are developed using web reversal mechanisms. For the details of these web reversal mechanisms, reference is made to U.S. patent application Ser. No. 867,411, filed Apr. 13, 1992, U.S. Pat. No. 5,326,899, the contents of which are incorporated by reference herein.

It can be noted from FIG. 1 that at each of these web regions, the paper web 9 forms a short open draw; i.e. it is temporarily not supported by a felt. In the region of a small suction zone of a transfer roll 58, it travels in each case onto the next felt. In FIG. 1, these transfer rolls 58 are the sole suction rolls having internal stationary suction boxes. The guide suction rolls 51' to 56', on the other hand, do not have inner stationary inserts or direct suction connections. Rather, an external suction box 59 is provided on each of these transfer suction rolls. This box lies in the pocket between two adjacent dryer cylinders and has a ledge 60 (see FIG. 7) at the place where felt F and web 9 leave together the first of these two cylinders, the ledge 60 stripping off and diverting the layer of boundary air-carried along by the felt.

The last single-felt dryer group 16 is followed by a double-felt dryer group 17 having several bottom cylinders 57 and several top cylinders 57', as well as a bottom felt UF and a top felt OF. Here, the web 9 travels meandering between the lower and upper cylinders. In FIG. 1, a tail cutter S is indicated between the last two cylinders.

The dryer section shown in FIG. 2 has for instance three (or four or five) single-felt dryer groups 21–23; however, in contrast to FIG. 1, they are all top-felted. In other words, all dryer cylinders 71–73 contact the bottom side of the web. Another difference from FIG. 1 is that the guide suction rolls 71' to 73' have inner stationary suction boxes and are arranged at only a slight distance from the adjacent dryer cylinders. Furthermore, for example, two (or three) double-felt dryer groups 24, 25 are provided with bottom cylinders 74, 75 and with top cylinders 74' and 75'.

Figure 3:
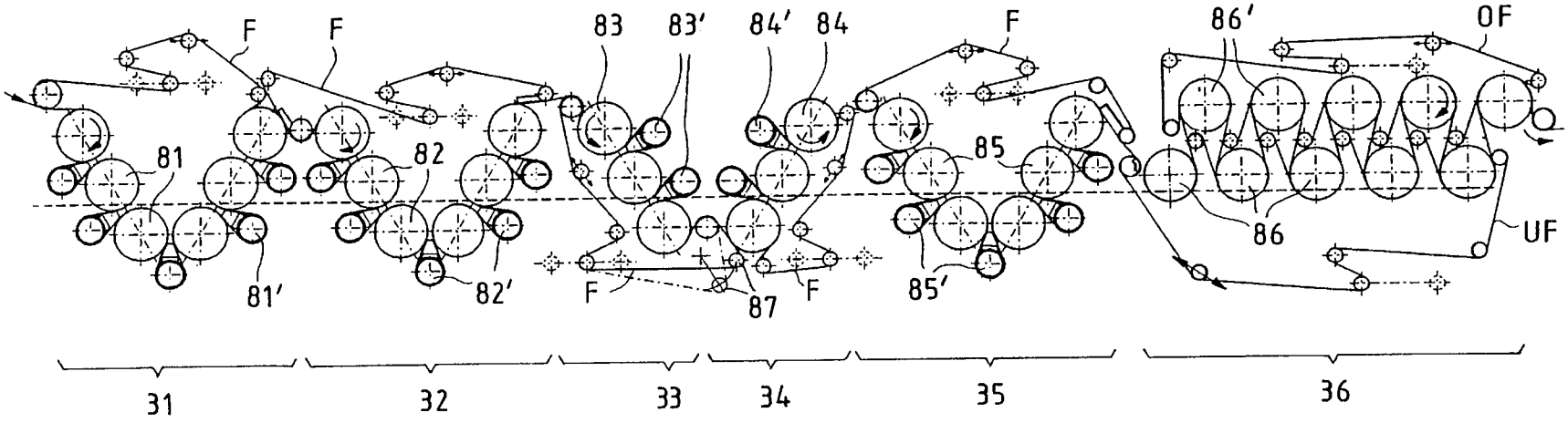
Figure 4:
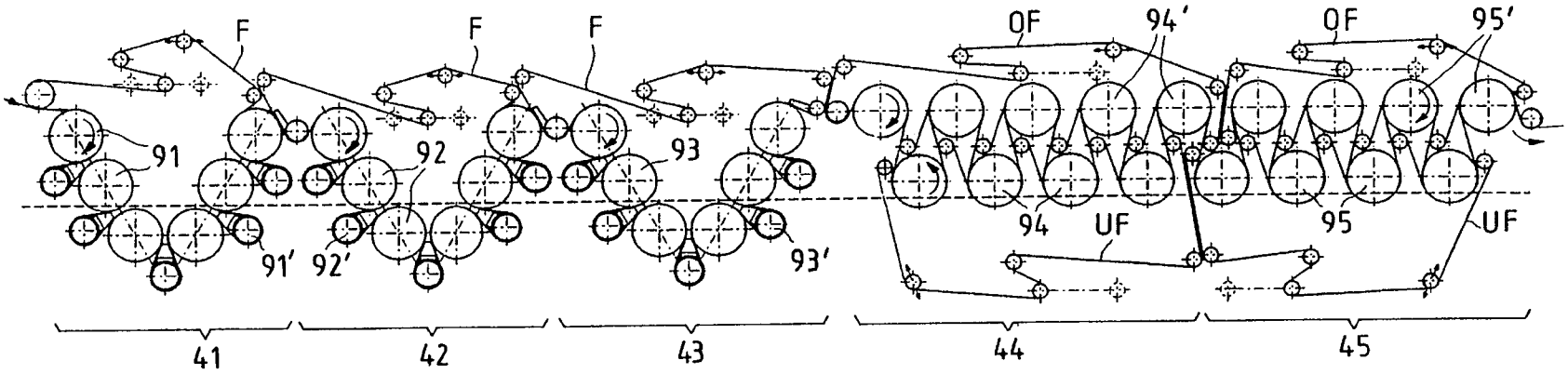

The dryer sections of FIGS. 1 and 2 have only horizontal rows of cylinders. In FIGS. 3 and 4, however, in order to shorten the overall structural length of the dryer section, the cylinders of the single-felt dryer groups are arranged in several rows which are inclined to the vertical direction, with rows inclined rearward alternating with rows that are inclined forwards. In accordance with FIG. 3, two V-shaped double rows form a first group 31 and a second dryer group 32. The cylinders 81, 82 of these two dryer groups are top-felted. This is followed by two bottom-felted dryer groups 33, 34. For example, the three (or four) cylinders 83 of the third dryer group form a rearward inclined row. On the other hand, the cylinders 84 of the fourth dryer group form a forward inclined row.

Between the lowermost cylinders of these two dryer groups 33, 34, a slot or gap can be opened by a swingable felt guide roll 87, in order to remove broke in the downward direction. The fifth dryer group 35 again has solely top-felted dryer cylinders 85, which again form a V-shaped double row. Behind the last cylinder of this dryer group 35, the web is guided obliquely downward to the first lower cylinder 86 of the following double-felt dryer group 36. In accordance with FIG. 4, solely top-felted and V-shaped single-felt dryer groups 41, 42 and 43 are present, followed by two double-felt dryer groups 44 and 45. In both FIGS. 3 and 4 all transfer suction rolls 81' to 85' and 91' to 93' which are located in the corresponding dryer group between two cylinders are arranged at a larger distance from these cylinders and are provided with external suction boxes. This manner of construction does not merely involve less expense. It furthermore also saves drying section energy since a longer free evaporation path is present between every two cylinders so that the drying is more economical. These latter factors apply also to the arrangement in accordance with FIG. 1.

Figure 5:
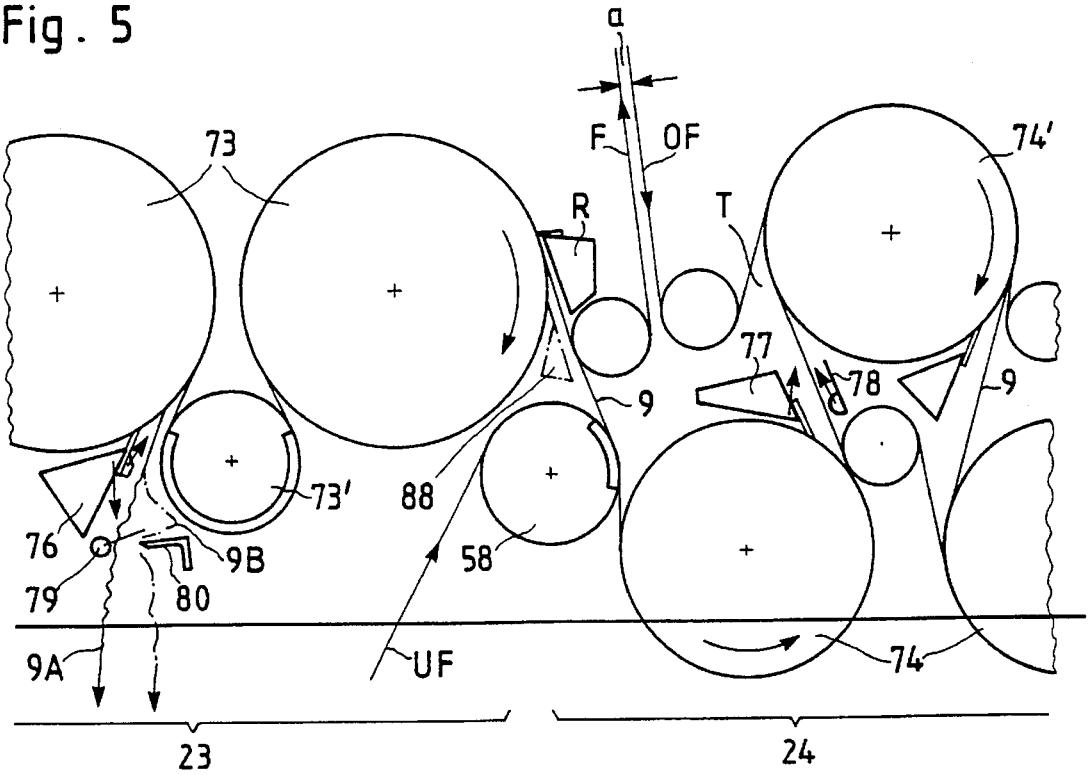
FIGS. 5 to 8 show diagrammatic side views (on a larger scale than in FIGS. 1 to 4) of the web transfer zone between a single-felt dryer group and a following double-felt dryer group having a corresponding tail guide means.

In FIG. 5 there can be noted the last two dryer cylinders 73 of the last single-felt dryer group 23 and the first three cylinders 74, 74' of the double-felt dryer group 24 of the dryer section shown in FIG. 2. There can furthermore be noted a guide suction roll 73' provided with internal suction box and (differing from FIG. 2), in front of the first lower dryer group cylinder 74, a transfer suction roll 58, also having a stationary inner suction box. An automatic ropeless tail guide device is formed in the single-felt dryer group 23 in the manner, for instance, that each guide suction roll 23 has an edge suction zone, known per se, at one of its two ends. Furthermore, air-blow devices are provided on a scraper support member 76, these devices being indicated symbolically by arrows, as well as an air-blow nozzle 79. At the place where the web 9 and the felt F travel jointly off from the last cylinder 73, an edge suction box R, web stabilizer or the like (acting only on the region of the tail) can be provided. Or a short tail-guide scraper 98 which covers only the region of the tail and may also have an air-blow nozzle is provided on the last cylinder 73 (for example, as shown in Federal Republic of Germany Utility Model 8 914 679).

An automatic ropeless tail guide device is also provided in the double-felt dryer group 24. It has the following construction. Along the free web travel path extending upward to the cylinder 74' there extends on the one hand a wall of a scraper support member 77 and, on the other hand, a guide plate 78, for example in accordance with Federal Republic of Germany Utility Model 9 109 313. Each of these elements has air-blow openings in order to expel a jet of blast air substantially in the direction of travel of the web. Above the first lower cylinder 74, the two felts F and OF travel parallel to each other at a small distance a apart (a=about 30–50 mm). In this way, it is avoided that the top felt OF transports large amounts of air into the pocket T, which would otherwise escape laterally towards the outside and could drive the oncoming tail towards the outside. The arrangement shown assures that the oncoming tail is reliably taken up and conducted further by the first cylinder 74'. It can also be used at the separation regions between two double-felt dryer groups (for instance 24, 25, FIG. 2), both on the top felts and on the bottom felts.

While air-blowing elements 77, 78 have been described above for threading the paper machine, vacuum producing devices, for example, of the type described in U.S. Pat. No. 4,022,366, the contents of which are incorporated by reference herein, may be used instead. After a successful tail threading operation, such a vacuum transfer apparatus may be pivoted to a location outside of the dryer group where it is located.

In accordance with a-further possible embodiment, one (or more) of the felt rolls may be formed as a suction roll and may arranged such that it is able to pick-up the web from the other felt, similar to the manner illustrated in U.S. Pat. No. 4,485,567.

If necessary, the following can be initially provided during the strip-feed or tail threading process. The vacuum is temporarily disconnected in the transfer suction roll 73' provided between the last two cylinders 73. Furthermore, the air-blow nozzle 79 is disconnected so that the tail, as shown at 9A, travels first downward into the cellar. When the tail then travels stably through the preceding single-felt dryer groups, a new tail tip 9B is formed by the blow nozzle 79 and a knife 80 and fed to the guide suction roll 73' which is again acted on by vacuum. Accordingly, the tail now travels to the two-felt dryer group 25 and through it up to the end of the dryer section. Such an arrangement is also present in FIG. 7.

Figure 6:
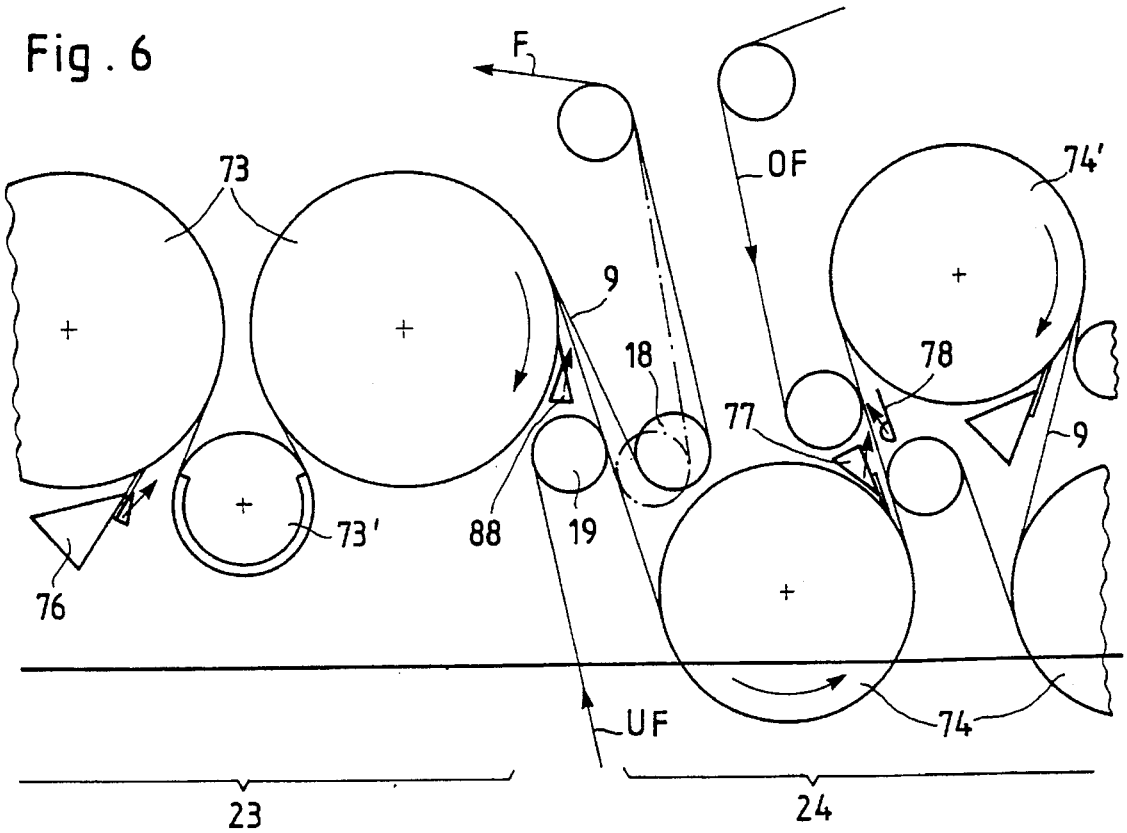

In accordance with FIG. 6, the following is provided between the last cylinder 73 of the single-felt dryer group 23 and the first lower cylinder 74 of the double-felt dryer group 24: A guide roll 18 for the felt F and a guide roll 19 for the bottom felt UF are so arranged that the felts overlap each other. During normal operation, a certain distance is present between the felts F and UF so that the web 9 travels freely, i.e., in an open draw, not supported by the felt F, from the cylinder 73 to the felt guide roll 19. During the threading of the tail, the guide roll 18 can be brought into the position shown in dash-dot lines so that the felts F and UF temporarily contact or almost contact each other. A tail guide scraper 88 can furthermore be provided.

Figure 7:
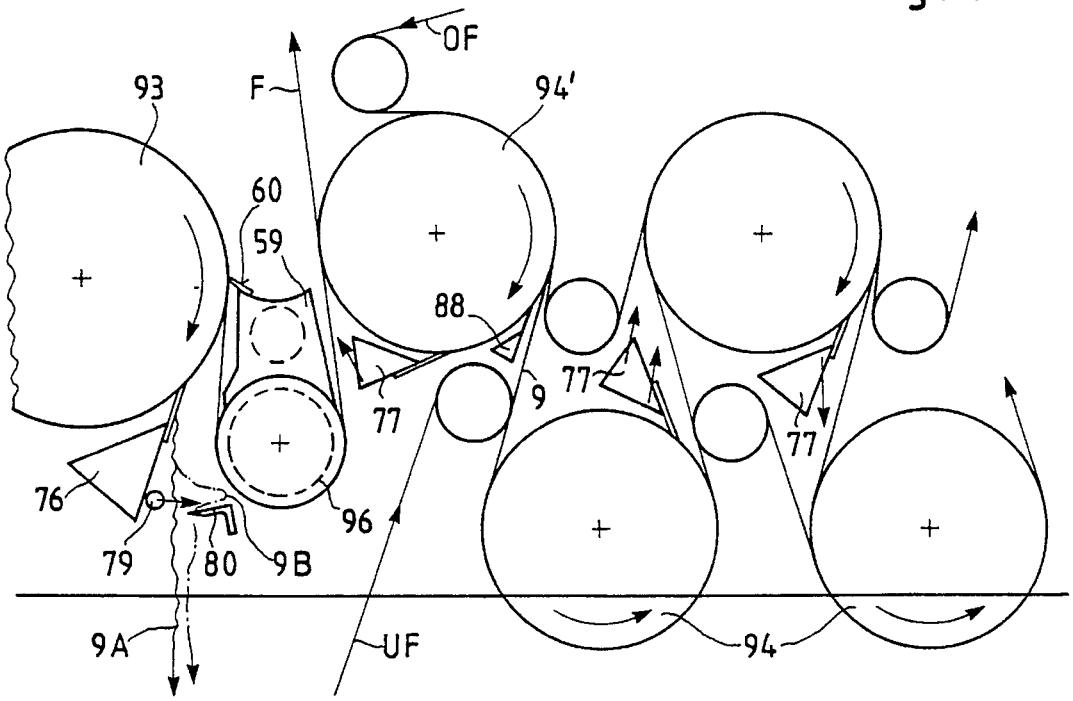
Figure 8:
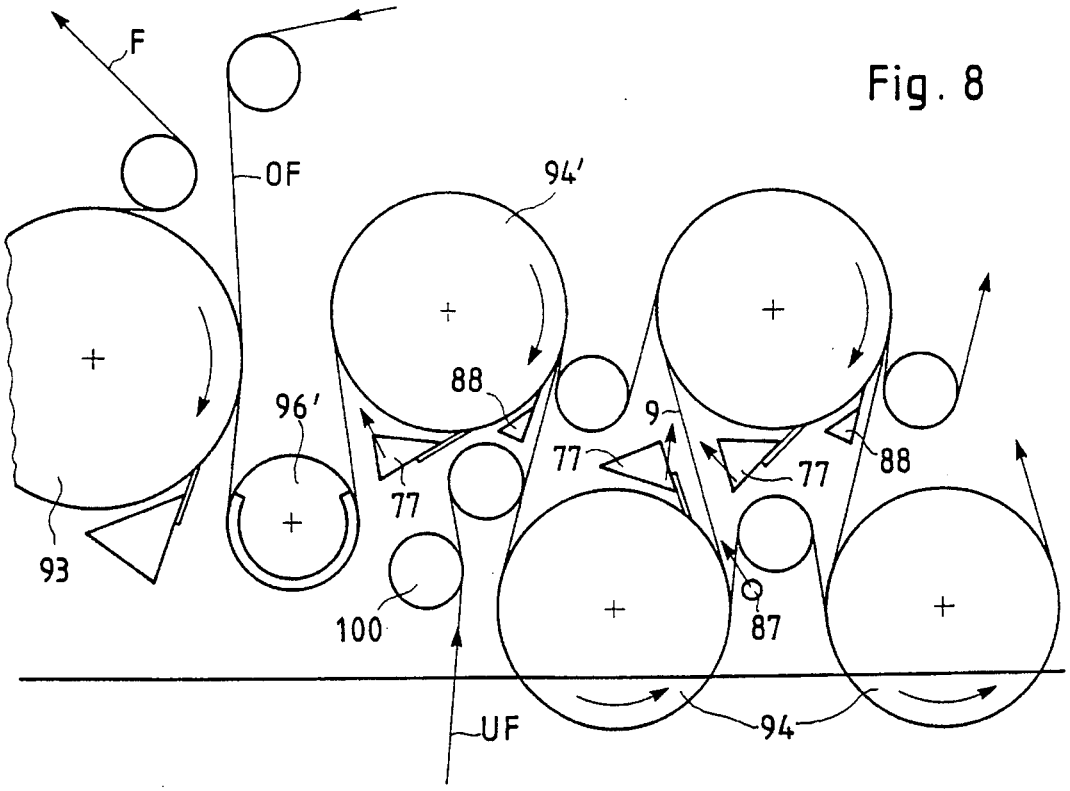

In FIGS. 7 and 8, the first cylinder 94' of the double-felt dryer group is an upper cylinder. Therefore a guide suction roll or reversing suction roll 96 is provided between it and the last cylinder 93 of the single-felt dryer group. This suction roll 96 can, as shown in FIG. 7, lie in the loop of the felt F of the single-felt dryer group, the felt F being tangent to the upper cylinder 94' and transferring the web 9 to it. In accordance with FIG. 8, the guide suction roll 96' can lie in the top felt of the double-felt dryer group. This felt tangentially contacts the last cylinder 93 of the single-felt dryer group and receives the web from it. An automatic ropeless tail guide device in the form of tail guide scrapers 88 and in the form of blow nozzles (represented symbolically by arrows) which are arranged on scraper support members 77 or on a separate blow pipe 87 can again be clearly noted in FIGS. 7 and 8. In order that the bottom felt UP which travels in the direction towards the first upper cylinder 94' does not unnecessarily convey air into the pocket T, an additional felt guide roll 100 (or an air scraper) can be provided.

Figure 9:
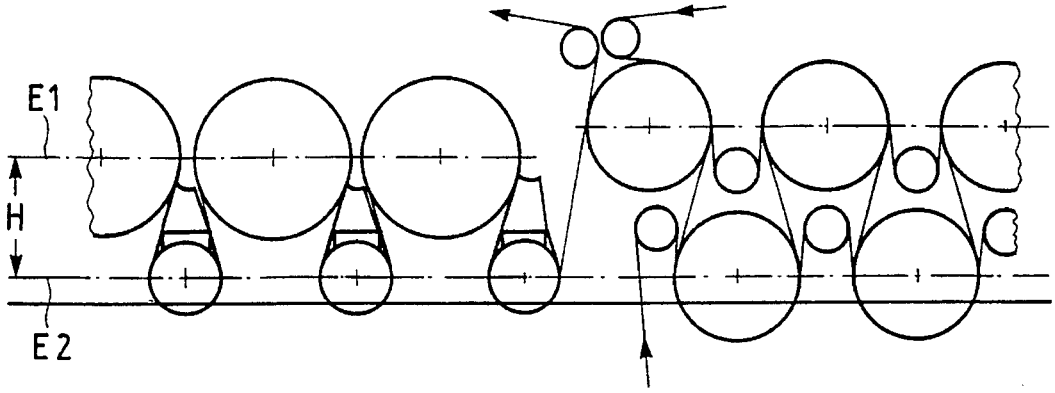
FIGS. 9 to 11 are similar to FIGS. 5 to 8 and show different vertical distances between the axes of the cylinders or guide rolls and a reference plane.

In FIG. 9 a larger distance H—as compared with FIG. 1—is provided between the planes E1 and E2 whereby an enlarged evaporation path is available for the web 9 between every two cylinders of the single-felt dryer group. The axes of the cylinders lie in plane E1, while the axes of the transfer suction rolls, and at least approximately the axes of the lower cylinders of the double-felt dryer group, lie in plane E2.

Figure 10:
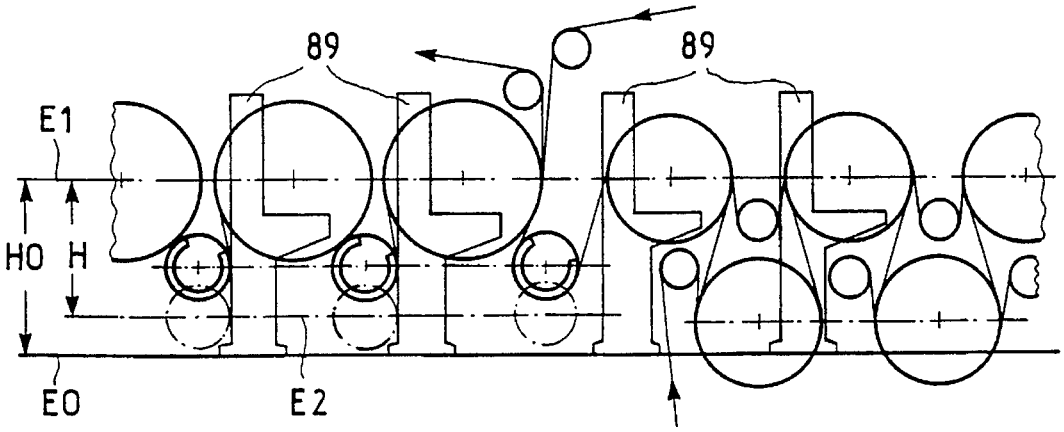

In accordance with FIG. 10 the following is provided, differing from FIGS. 1 and 2. The axes of the cylinders of the single-felt dryer group lie in the same horizontal plane E1 as the axes of the upper cylinders of the double-felt dryer group. Thus uniform stands 89 can be provided for all of these cylinders. Furthermore, in this way, the axes of the cylinders of the single-felt dryer group lie at a greater vertical distance HO above a reference plane EO than, for instance, the cylinders 56 in FIG. 1. It follows from this that the vertical distance H between the transfer suction rolls and the cylinders can be selected to be very large if evaporation paths still larger than in FIG. 9 are necessary between the cylinders. In this connection, the axes of the transfer suction rolls (indicated in dot-dash line) again lie at least approximately in the same horizontal plane E2 as the axes of the lower cylinders of the double-felt dryer group. The advantages described can be further increased if, in accordance with FIG. 11, the axes of the cylinders of the single-felt dryer group (plane E1) are arranged above the axes of the upper cylinders of the double-felt dryer groups (plane E3).

Figure 12:
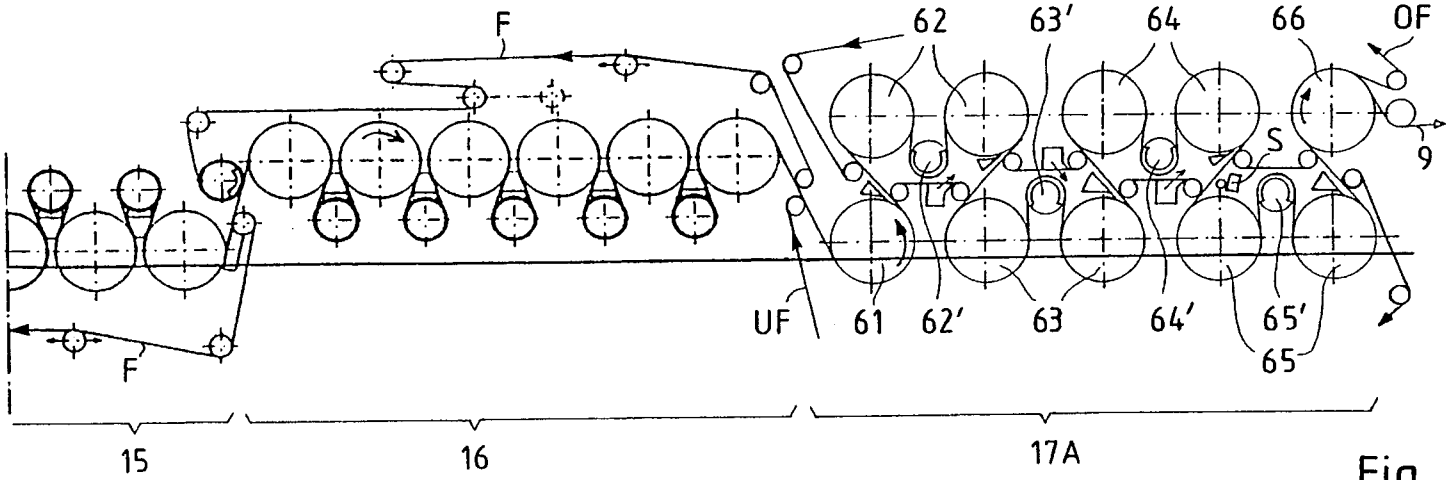
FIGS. 12 and 13 show other embodiments in a diagrammatic side view.

FIG. 12 shows an alternative to FIG. 1. The double-felt dryer group 17A is developed as follows in accordance with Federal Republic of Germany Patent 3 623 971. The paper web 9 travels first over a lower cylinder 61 and then, in succession, over two top cylinders 62 and then in succession over two bottom cylinders 63 and then, in succession, over the upper cylinders 64 and then in succession over two lower cylinders 65 and finally over an upper cylinder 66.

A guide suction roll 62'–65' is arranged between the cylinders of each cylinder pair 62–65. In this way, the number of open draws of the paper web between the two horizontal rows of cylinders is reduced by approximately one half. The threading of the tail can take place automatically in exactly the same manner as described above with reference to FIGS. 5 and 7, and therefore without ropes. Any paper broke obtained is automatically transported to the rear end of the dryer group 17A and pushed out there.

Figure 13:
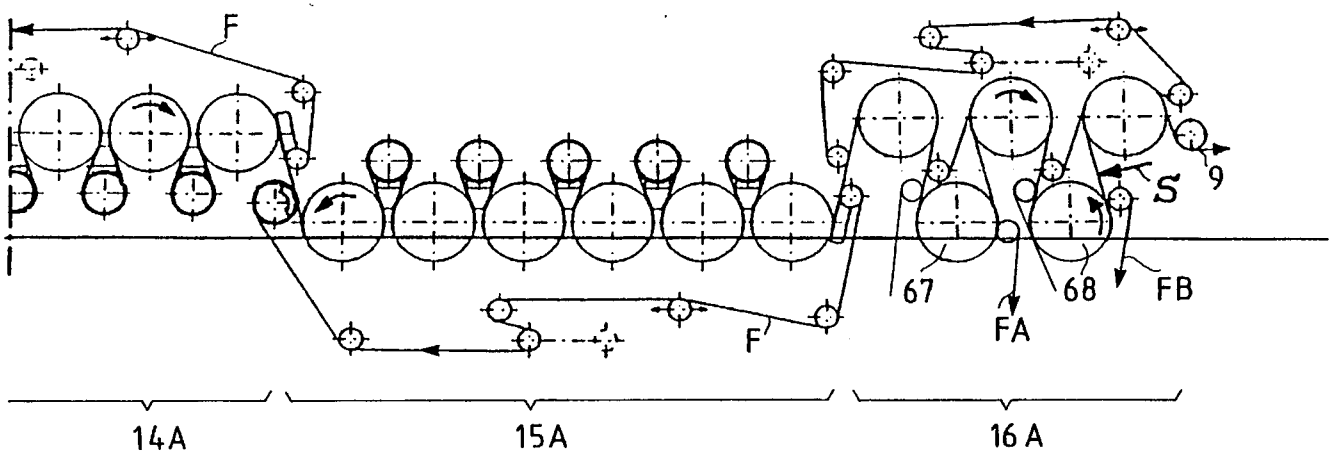

FIG. 13 shows that a bottom felted single-felt dryer group 15A can also be arranged directly in front or a double-felt dryer group 16A. In accordance with another alternative, each lower cylinder 67, 68 in the double-felt dryer group 16A has its own felt FA, FB in order to facilitate the discharge of broke. Note that the lower cylinders 67, 88 of the double-felt dryer group are horizontally aligned (same height) with the dryer cylinders of the preceding single-tier group.

Different from FIGS. 1–13, further equipment may be disposed between two of the dryer groups, e.g. between the last single-felt and the first double-felt dryer group.

Figure 18B:
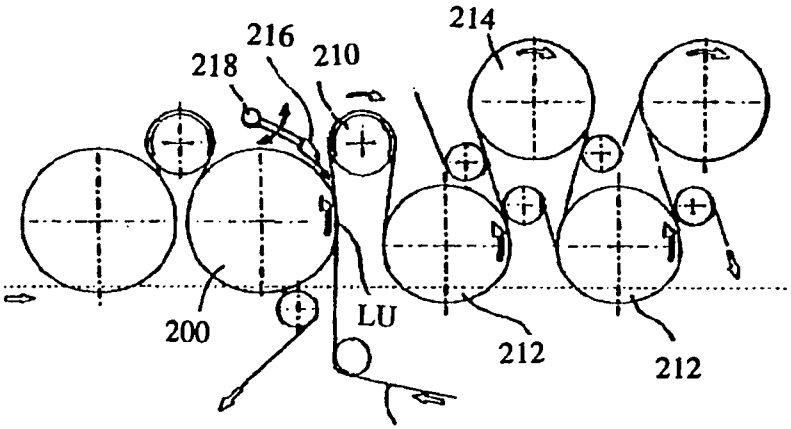
FIGS. 18A–18D illustrate web transfer arrangements between a bottom felted single-tier leading into a double-tier dryer group and further show different vertical alignments between the axes of the cylinders and guide rolls to a reference plane as well as the height alignment between the cylinders and guide rolls in the adjacent single-tier and double-tier dryer groups.
Figure 18D:
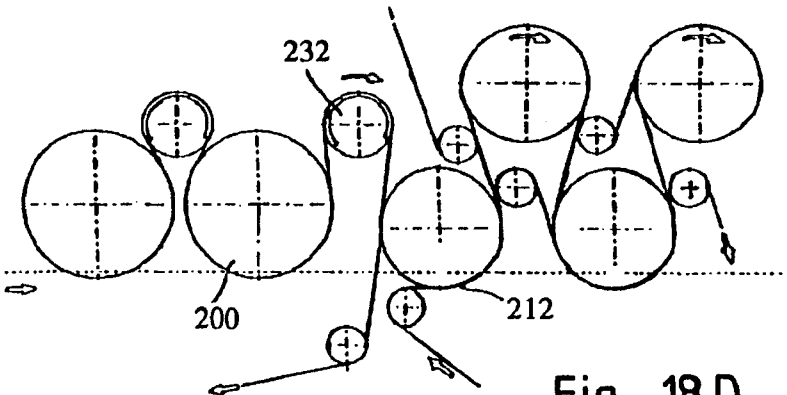
Figure 18A:
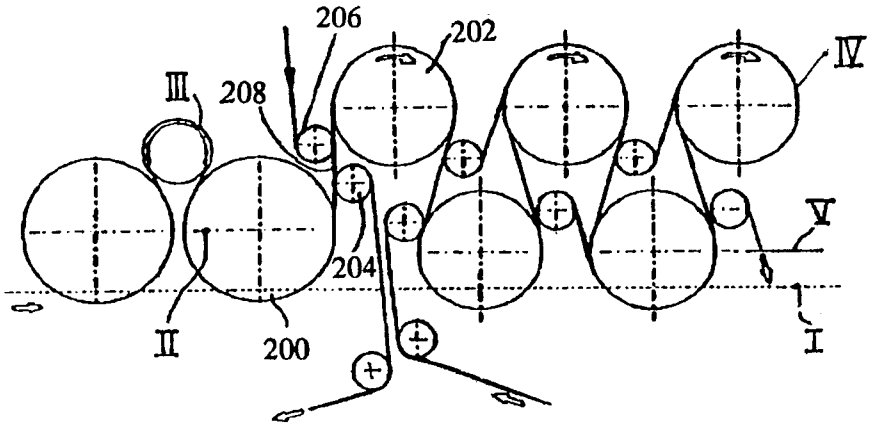

With reference to FIGS. 18A–18D, various web transfer arrangements for transferring a paper web from a bottom felted single-tier to a double-tier dryer group are illustrated. In FIG. 18A, the cylinders of the single-tier dryer groups lie in a plane II, its vacuum rolls in a plane III, and both planes II and II are located between the planes IV and V respectively of the top and bottom dryer cylinders of the succeeding double-tier group.

The paper web 208 travels in a generally straight upward path from the last dryer cylinder 200 of the single-tier group to the leading top cylinder 202 of the double-tier group. The felt rolls 204 and 206 (of the single-tier and double-tier groups respectively), are situated close to one another to provide a relatively short open draw for the paper web at the transfer region. Note further that the diameter of the cylinders in the double-tier group is somewhat smaller than the cylinders in the double-tier group. This provides several advantages. It enables easier access to the pocket areas P1, P2, P3 between the top and bottom cylinders in the double-tier group. Further, if desired, it permits placement of the top and bottom cylinders closer to one another to reduce the size of the open draws of the paper web between the upper and lower cylinders in the double-tier dryer group. It also reduces the height above the floor of the upper cylinders 202, enhancing accessibility and servicing of the machine.

In accordance with FIG. 18B, the felt 220 of the bottom cylinders 212, 212' of the double-tier group makes a lick-up, tangent contact with the trailing cylinder 200 of the single-tier group at a point LU, where the paper web transfers to the felt 220, and thereafter guided around the vacuum roll 210 toward the leading bottom cylinder 212. During threading, an air nozzle or similar device 216 produces a jet of air to ensure that the leading end, i.e. tail, of the paper web continues with the felt 220. Air nozzle 216 can be supported on an arm which is connected at a pivoting mechanism 218 so that it can be removed from its illustrated location close to the cylinder, for example in order to facilitate the removal of broke from atop the cylinder 200.

Figure 18C:
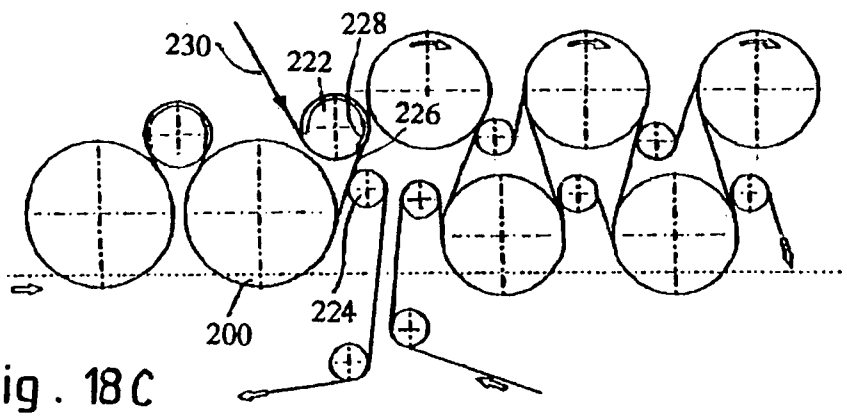

In accordance with FIG. 18C, the path of the paper web from the trailing cylinder 200 is toward the felt roll 224 and thereafter across a relatively short open draw 226 to a leading vacuum roll 222 toward the leading top cylinder of the double-tier group. The vacuum roll 222 is provided with a relatively short vacuum zone 228 to support the paper web against the felt 230 that is associated with a double-tier group.

FIG. 18D has an arrangement of drying cylinders and vacuum rolls as in FIG. 18B but differs therefrom in that the illustrated vacuum roll 232 is felted by the felt of the single-tier group and carriers the paper web to a lick-down, tangent contact with the leading bottom cylinder 212 of the double-tier group.

Figure 19:
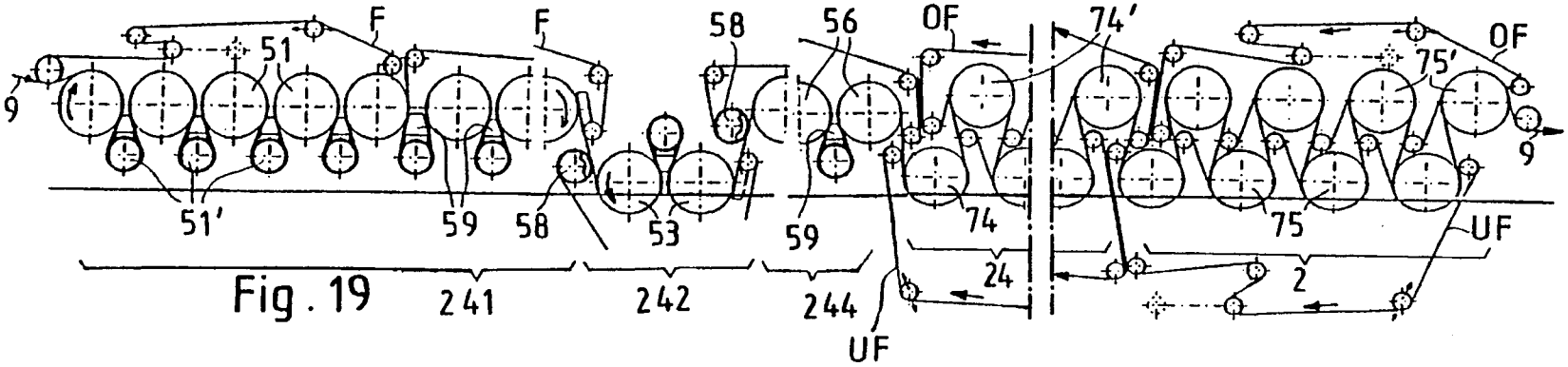
FIG. 19 illustrates yet another possible planar alignment between single-tier and double-tier groups.

FIG. 19 illustrates an arrangement wherein the paper web travels first through several single-tier dryer groups arranged alternatingly as a top felted single-tier group 240 followed by a bottom felted single-tier group 242, thence a top felted single-tier group 244 and terminating in a double-tier group 246. Note that in this arrangement the dryer cylinders of all of the top felted single-tier groups i.e. in the same plane as the cylinders of the upper tier of cylinders in the double-tier group 246. Similarly, the cylinders of the bottom felted dryer group 242 have their axis of rotation in the same horizontal plane as the axis of rotation of the bottom cylinders of the double-tier group.

As has been mentioned, the inventors herein have discovered that optimization of the paper web transfer point between single-tier dryer groups and the double-tier dryer groups in a mixed drying section substantially impacts the overall quality, cost and operational characteristics of a drying section. They have developed the insight that the optimal transfer point should be determined by reference to the percentage of the drying cylinder surface contacted by the paper web in the single-tier versus in the double-tier dryer groups. The results of their studies and investigations are illustrated in FIGS. 17A–17E. These results depend on a number of factors, but primarily on the grade of paper and have been determined for the indicated speed ranges and predicted to hold for speeds of at least up to 2,000 meters per minute. Thus, in accordance with FIG. 17A, of the entire dryer cylinder surface traversed by the paper web during its path through the entire drying section, at least 41% but as much as 61% of the drying surface should be provided in the single-tier dryer groups. The optimum transfer point is at the 50% value. The foregoing data has been evolved for newsprint which has a paper weight of about 35 to 56 grams per meter squared as shown in the figure. Note that the dryness percentage of the paper web at the point of transfer will be in the range of between 50 and 55%.

Figure 17A:
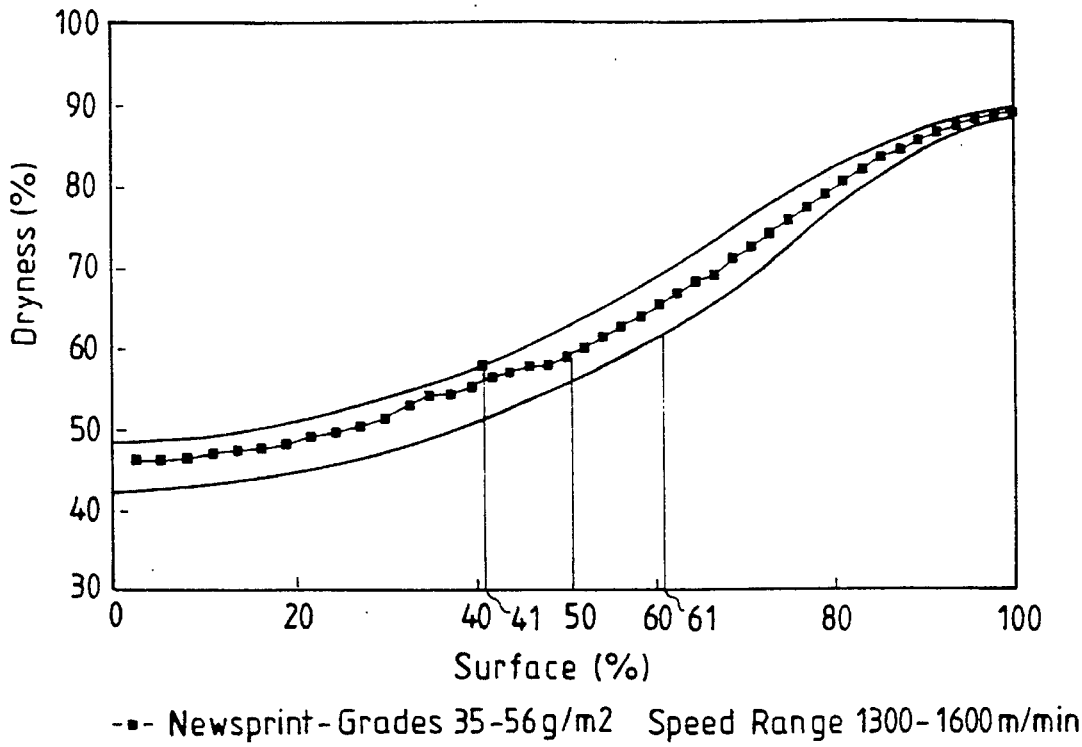
FIGS. 17A–17E are graphs showing the optimal proportions between single-tier and double-tier drying surfaces for various paper grades.
Figure 17B:
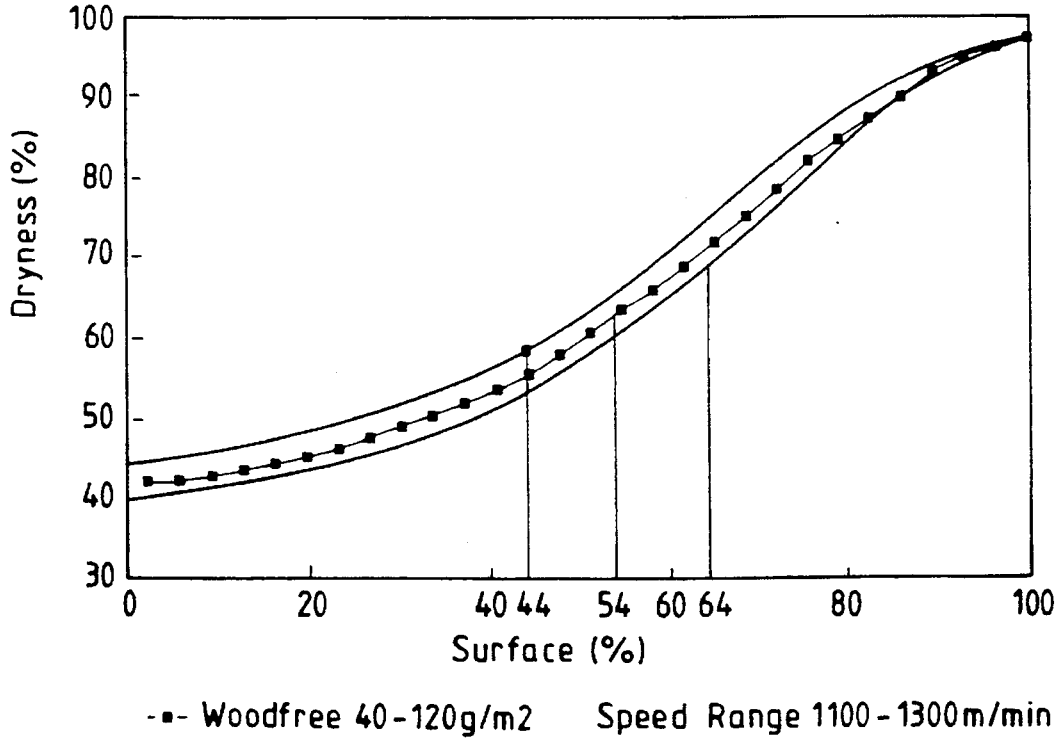
Figure 17C:
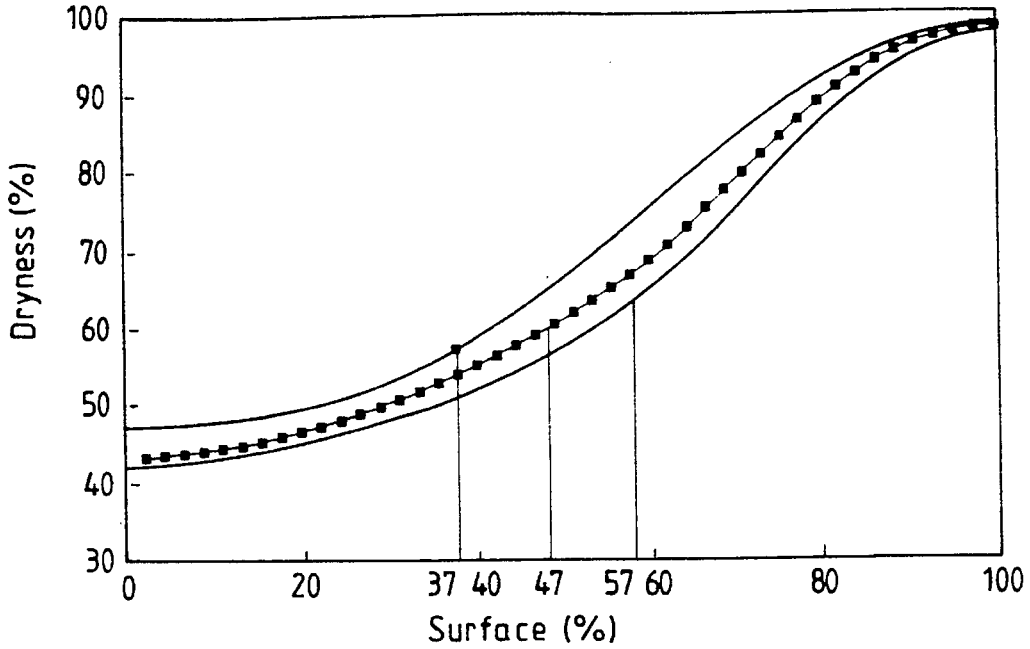
Figure 17D:
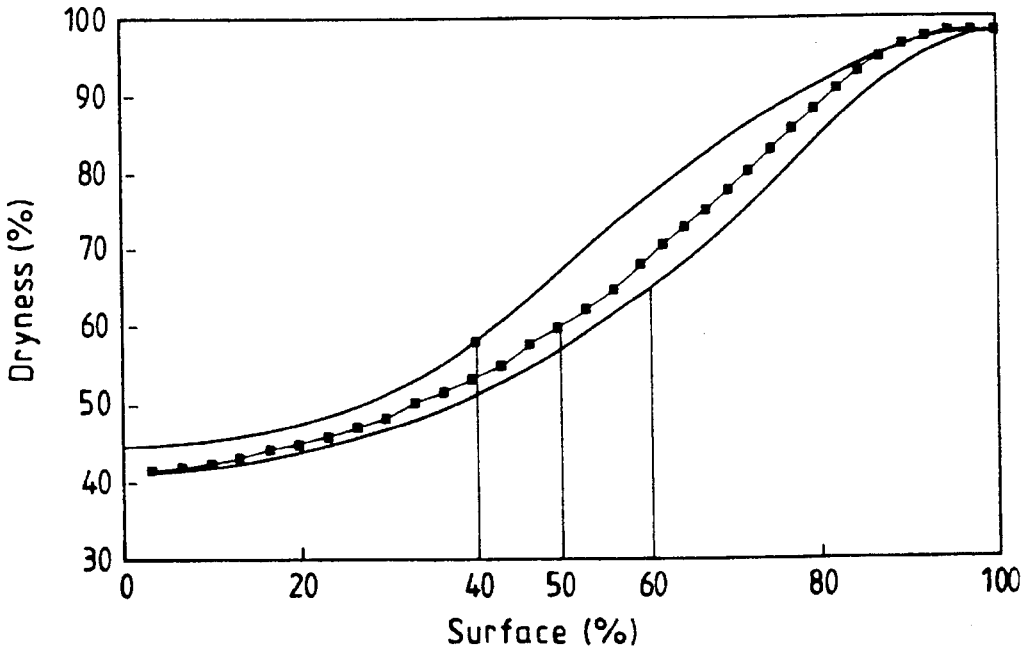
Figure 17E:
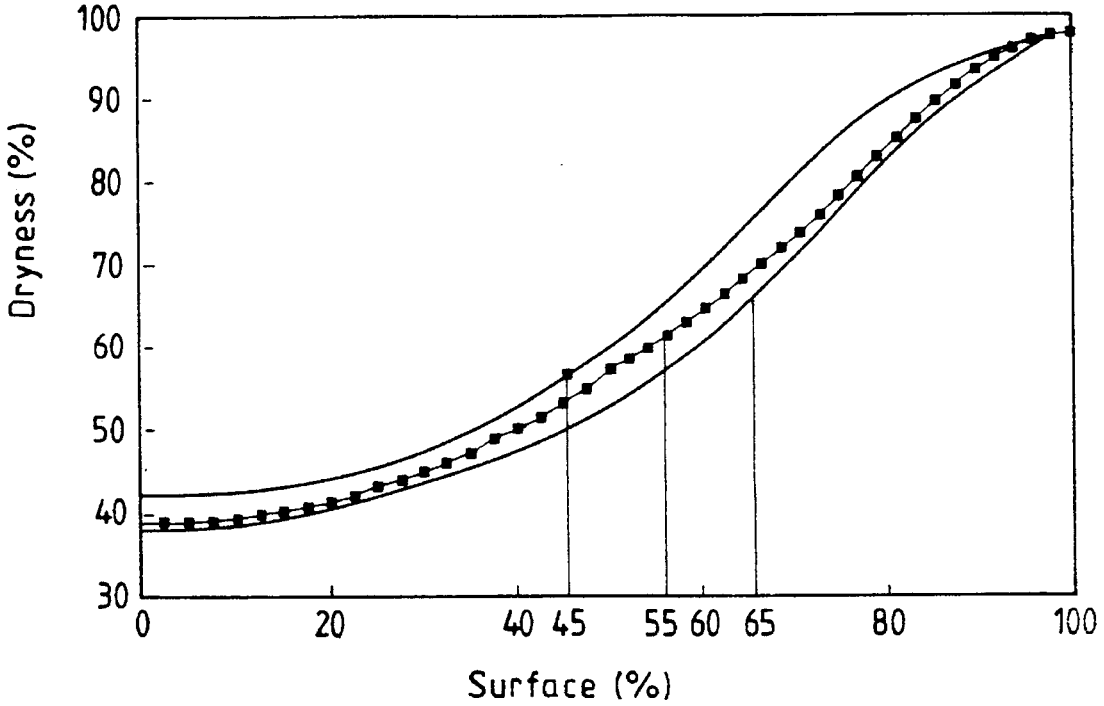

The results for other paper grades are shown in the remaining FIG. 17B–17E. FIG. 17B shows the result for a paper grade which has a basis weight of between 40 and 120 grams per meter squared. The optimal transfer point is at a point after the paper web has traveled over 54% of the total cylinder surface in the single-tier dryer groups. The optimal range is from 44 to 64%. The figures for supercalendered paper web are shown in FIG. 17C. FIG. 17D shows the results for lightweight coated paper. Copy paper which has a basis weight of approximately 75 grams per meter squared should be transferred at a point where at least 45 to as high as 65% of the cylinder surface has been allocated to the single-tier. The optimal transfer point is at 55%.

In all of the examples, note that the drying percentage of the paper web at the point of transfer hovers somewhere between 50–60%. The result of the data which is illustrated in the aforementioned figures is summarized in the Table below:

| Percentage Single-Tier Surface Range | Optimal Value | Paper Type | Basis Weight |
|---|---|---|---|
| 41–61% | 50 | Newsprint | 35–56 g/m$^2$ |
| 44–64% | 54 | Wood Free | 40–120 g/m$^2$ |
| 37–57% | 47 | Supercalendered | 46–64 g/m$^2$ |
| 40–60% | 50 | Lightweight Coated | 30–50 g/m$^2$ |
| 45–65% | 55 | Copy | 75 g/m$^2$ |

Figure 20:
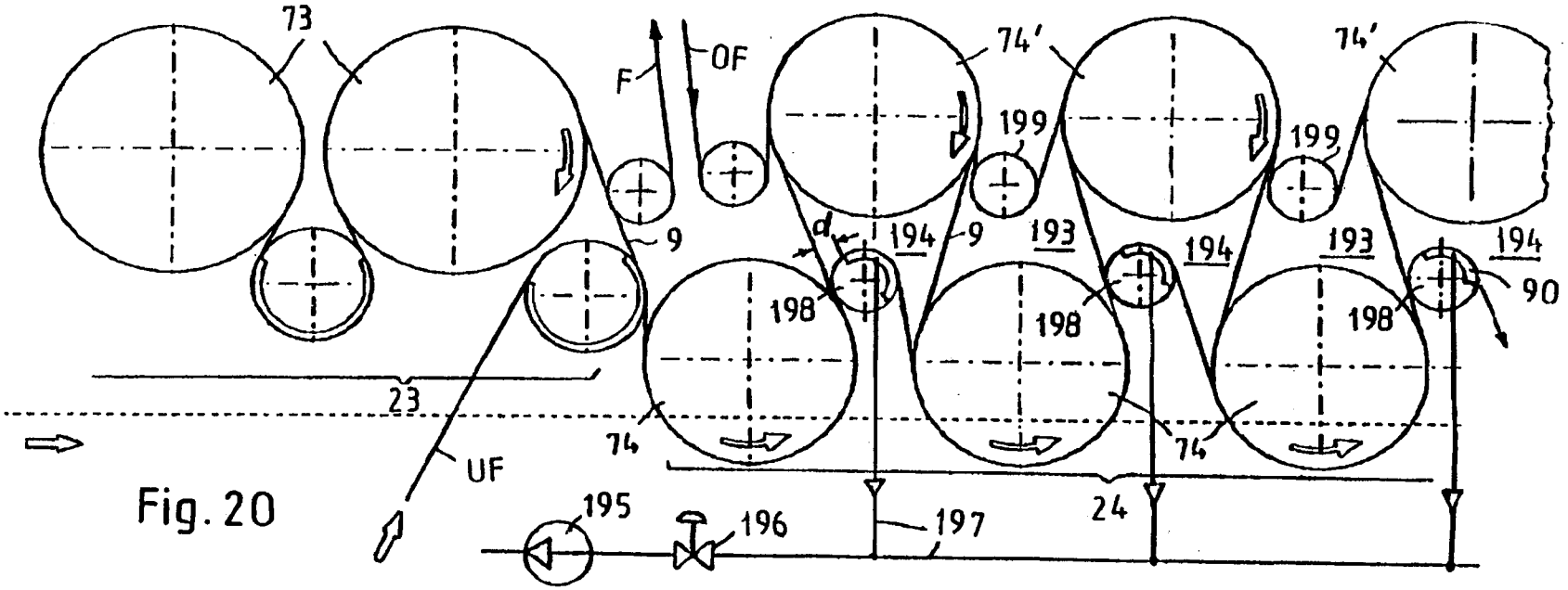
FIG. 20 shows a further embodiment of the invention, in a diagrammatic side view.

In FIG. 20, a further aspect of the invention is disclosed. The configuration shown in FIG. 20 is similar to that of FIG. 5 and comprises the last two dryer cylinders 73 of the last single-tier dryer group 23 having one felt and the first six cylinders 74, 75' of the first double-tier dryer group 24 having an upper felt OF and a lower felt UF as well as upper felt rolls 199 and lower felt rolls 198 with each felt roll being positioned between two adjacent dryer cylinders.

Either the upper felt rolls 199 or the lower felt rolls 198 are formed as suction rolls. (In a further alternative, all felt rolls 198 and 199 may be formed as suction rolls). In the embodiment shown, only the lower felt rolls 198 are suction rolls and are connected via suction lines 197 (comprising a control valve 196) to a suction blower 195. In operation, the lower suction felt rolls 198 remove moist air from every other pocket 194, namely from the pockets which are below the upper cylinders 74' and which "contact", i.e. which face, the bottom side of the paper web 9. Thus the evaporation of the bottom web side is being enhanced relative to the evaporation of the top web side. That mode of operation is able to eliminate any tendency of curl of the finished paper web which curl may result from the last single-tier dryer groups 23 or from other factors. More specifically, the enhanced evaporation of the bottom side of the web 9 counteracts a tendency of upward-curl, if any.

Accordingly, if there is a tendency of downward curl of the finished paper web, then additional moisture removal should be caused from the pockets 193 which are positioned above the lower cylinders 74. For that purpose the upper felt rolls 199 should be suction rolls (not shown in FIG. 20). If one cannot predict, whether there will be the tendency of upward-curl or of downward-curl, then all felt rolls 198 and 199 should be suction rolls. In that case, the lower suction felt rolls 198 should be controllable by control valve 196 as shown in FIG. 20 and the upper suction felt rolls 199 should have a separate suction line (not shown) with a further control valve. It is then possible to enhance the evaporation of either the top side or the bottom side of the paper web 9 depending on the type of curl (downward or upward-curl) that occurs.

Instead of providing suction felt rolls, there are other possibilities to control the amount of evaporation of the two sides of the paper web. For example, if the drying cylinders are equipped with doctors (see FIG. 5), moist air may be removed through the hollow doctor beams. Another possibility is to blow dry air either into the pockets 194 which are positioned below the upper cylinders 74' or into the pockets 193 which are above the lower cylinders 74. For that purpose, air blowing devices (not shown) will be positioned below the lower felt rolls 198 and/or above the upper felt rolls 199 which devices blow dry air through the lower felt UF and/or the upper felt OF into the respective pockets 193/194. Such blowing devices per se are known to those skilled in the art.

The lower suction felt rolls 198 shown in FIG. 20 have a further advantage. If a web breakage occurs, paper broke is automatically transported—with the aid of the negative pressure in the lower suction felt rolls 198 from one lower cylinder 74 to the next lower cylinder 74 up to the end of the double-tier drying group 24. In that case of web breakage, the control valve of upper suction felt rolls, if those are present, should be immediately closed.

The suction felt rolls 198 have, as usual, a perforated roll shell and an internal suction which defines a suction zone 190, as schematically depicted. Note that the suction zone 190 is open to the adjacent pocket 194 and that there must be a distance "d" between the normal path of web 9 and the suction zone 190. Thereby it is avoided that the web might travel together with felt UF around the suction felt roll 198.

Figure 11:
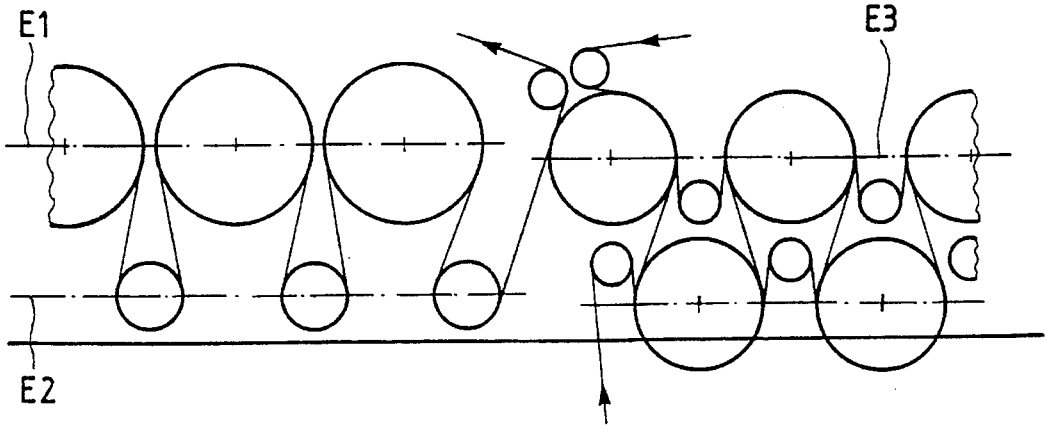

While FIG. 20 depicts one particular position for the lower suction rolls 198, the foregoing advantages are also attained when the felt suction rolls 198 are symmetrically disposed between the lower cylinders 74, as illustrated for example in FIG. 11.

Figure 14:
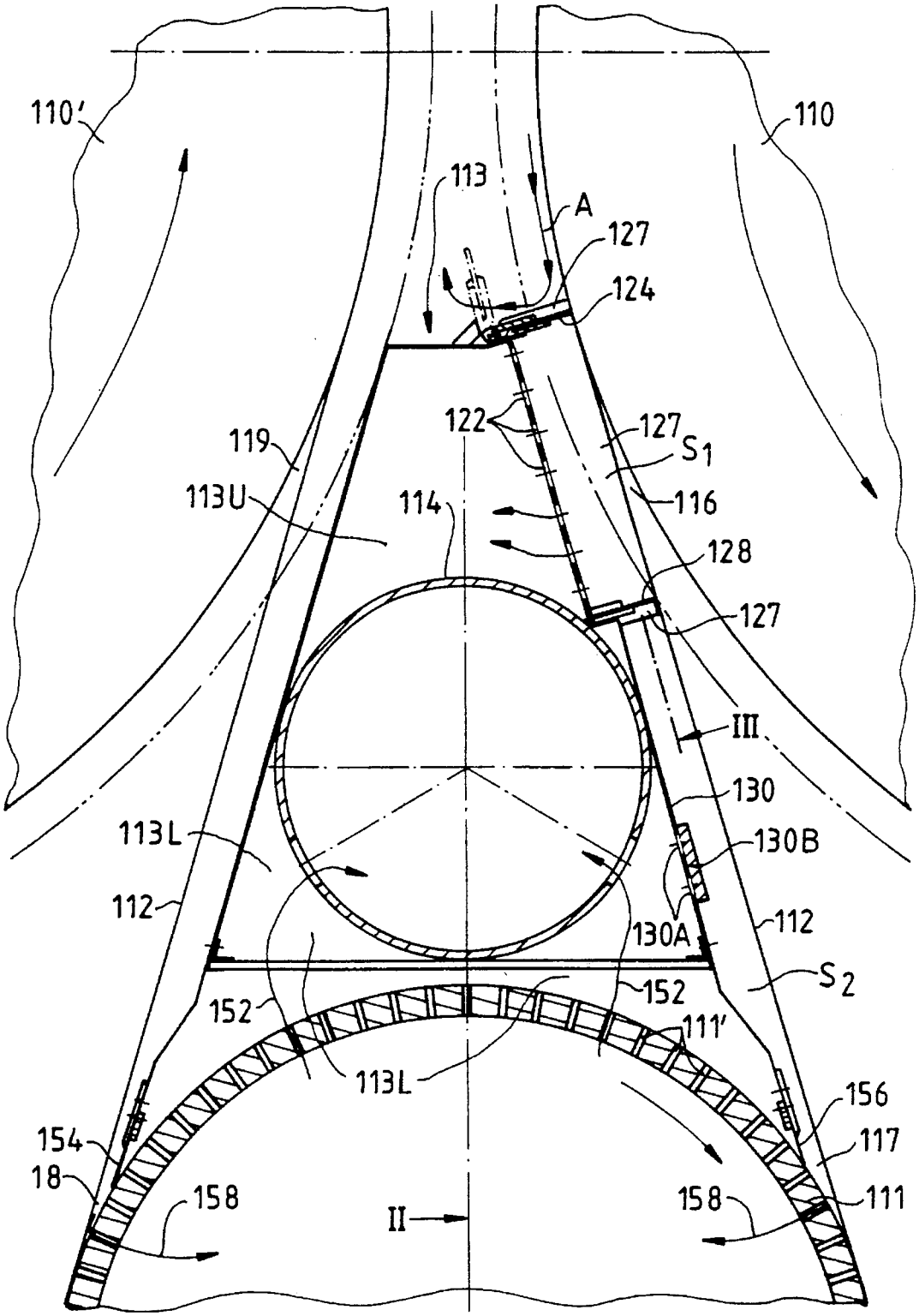
FIG. 14 illustrates details of a vacuum box that is operable in conjunction with a perforated guide roll for the single-felt dryer groups of the present invention.
Figure 15:
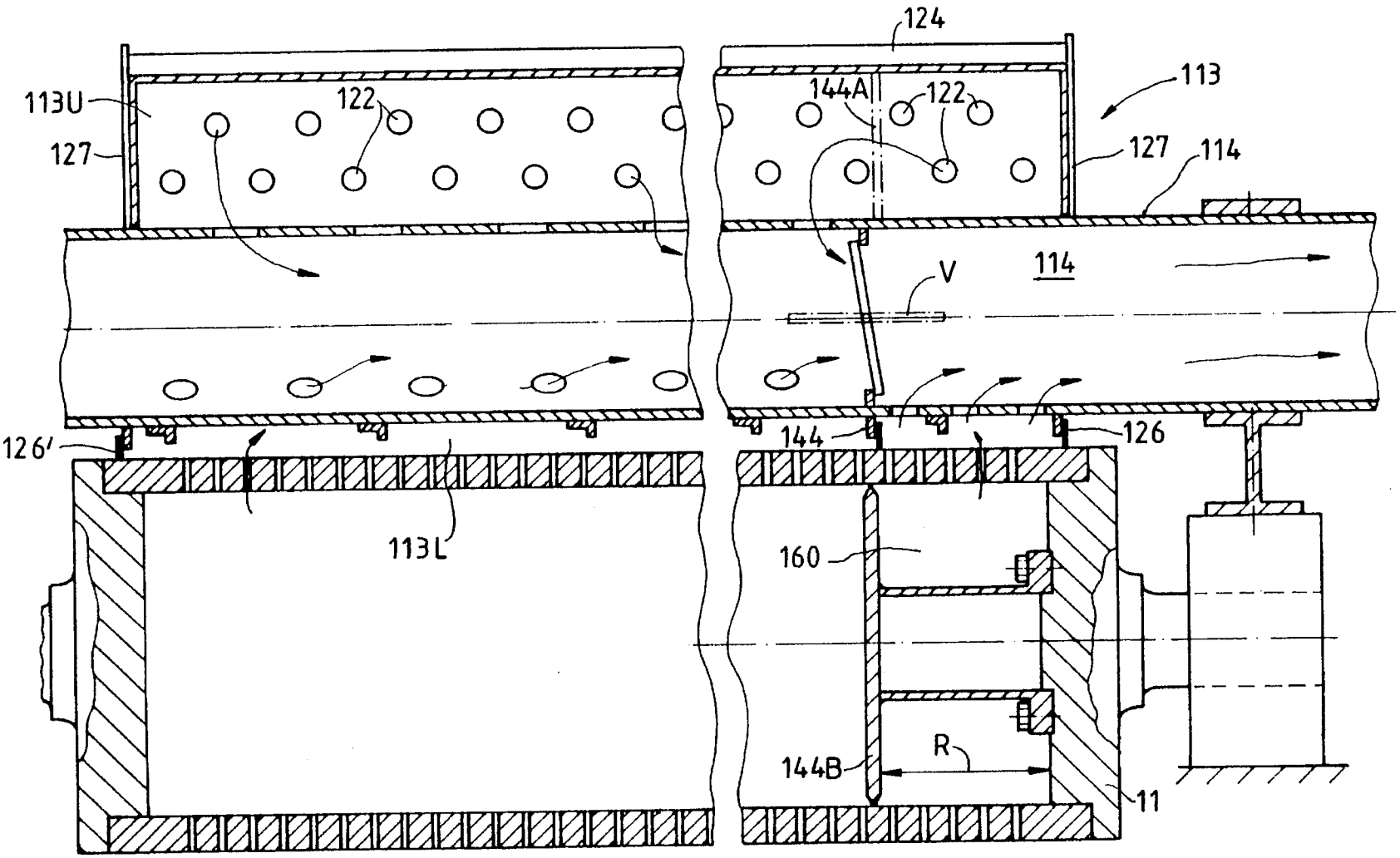
FIG. 15 is a cross-section through line II of FIG. 14.
Figure 16:
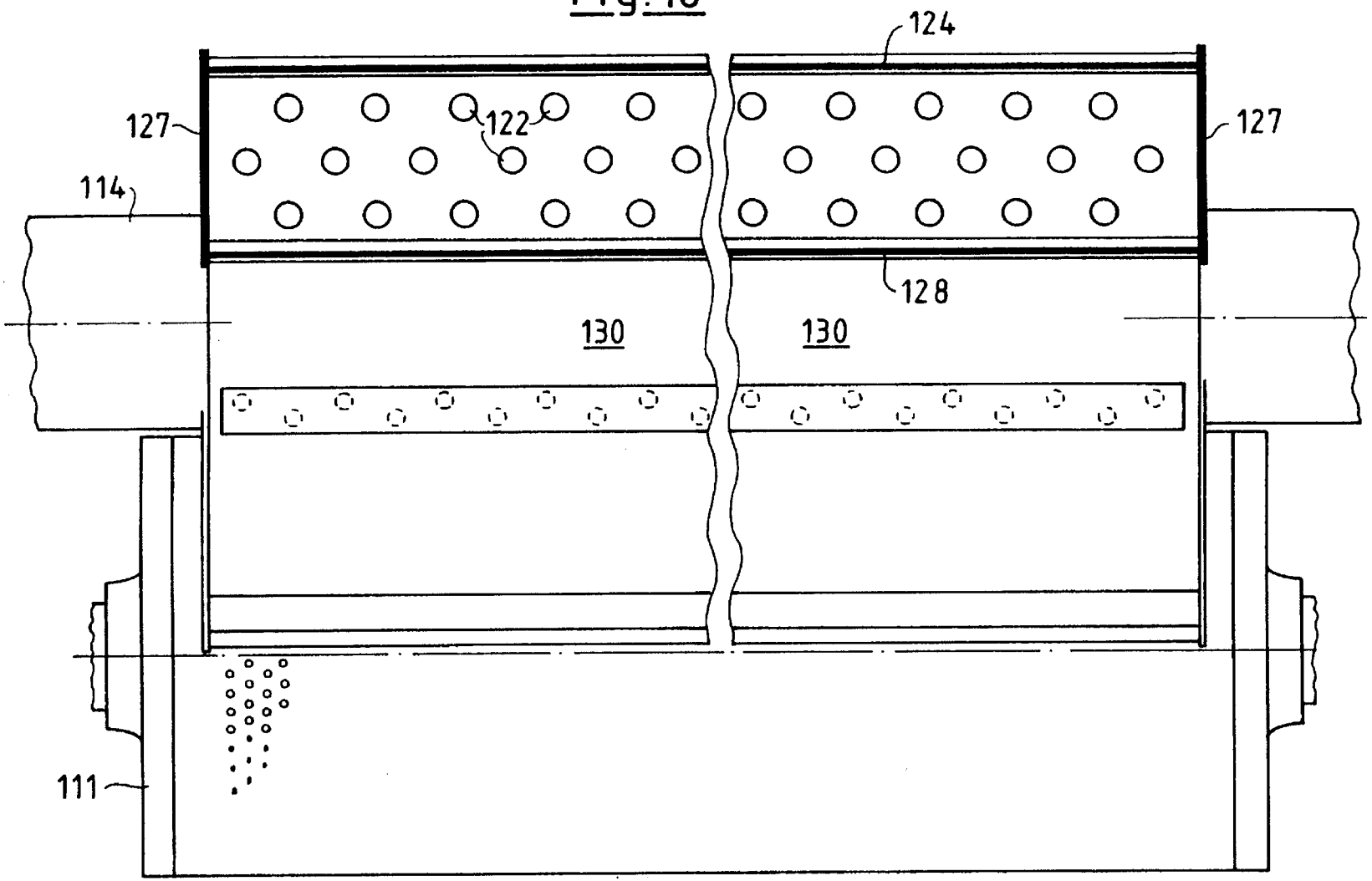
FIG. 16 is a cross-section through line III of FIG. 14.

Referring now to FIGS. 14–16, an advantageous embodiment of an external suction box that is operable in connection with the guide suction rolls 51'–56' is described next. As illustrated in FIG. 14, the paper web travels jointly with a felt forming a felt/paper run 12 which proceeds from a first counterclockwise rotating heated drying cylinder 110, around a clockwise rotating perforated guide roll 111 (corresponding, for example, to any one of the guide suction rolls 51'), to a second downstream, heated cylinder 110'. The external vacuum box 113, located in the pocket defined between the three rolls 110, 111 and 110', has an overall trapezoid shape and includes a perforated suction tube 114 which divides the interior space of the external vacuum box 113 into an upper chamber 113U and a lower chamber 113L.

The right-hand side wall 130 of the box 113 facing the web/felt run 12 and extending between the heated cylinder 110 and the guide roll 111 contains perforations 122 on the region thereof located between the laterally extending seals 124 and 128. The seals may be placed at a very small distance (e.g. 1–2 mm) from felt 112 or may slightly contact the felt 112. The space S1 bounded by the perforated portion of the side wall 130, the seals 124 and 128, and the web/felt run 112 is closed off by laterally extending seals 127 (FIG. 15). Thereby, a partial vacuum induced in the upper chamber 113U (through the perforated tube 114) acts through the perforations 122 to create a partial vacuum in the bounded space S1 to in turn purge air from the wedge-shaped region or nip 116 (FIG. 14) defined by the heated cylinder 110 and the web/felt run 112. The purpose is to suck the paper web away from the surface of the cylinder 110 onto the felt 112.

It is notable that the lateral seals 27 do not extend and seal the space S2, which borders on the central nor, indeed, most of the felt run 112.

Arrows 152 in FIG. 14 indicate the path of air being evacuated from the interior of the perforated roll 111, via perforations 111', lower chamber 113L and the tube 114. The vacuum in roll 111 serves the dual purpose of causing the web to adhere to the felt as the felt/web joint run 112 travels around the roll 111 and to generate a vacuum in the wedge-shaped nips 117 and 118 defined between the felt run 112 and the roll 111. The seals 154 and 156, which engage the perforated shell 111 at approximately the 2 o'clock and 10 o'clock positions thereon, ensure that the vacuum acting from within the roll 111 is effective to purge air from the wedge-shaped regions 117, 118, as well as from the runs 112 extending between the heated cylinders 110 and 110' and the perforated shell 111. The arrows 158 indicate the evacuation path from the wedge regions 117, 118 into the roll 111.

FIG. 15 shows an inner seal 144B in the perforated shell 111, defining a threading chamber 160. Seals 126 and 144 confine the suction from the tube 114 to the threading chambers 160 of roll 111 when the valve V is closed, typically during threading. In normal operation, the valve V is opened and the entire perforated roll 111 is subject to a substantially uniformly distributed vacuum. When the valve V is closed, the upper chamber 113U of the box 113 is closed off from the vacuum in the tube 114.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dryer section for drying a paper web in a drying section, comprising:

a) a plurality of successively arranged dryer groups, each group including a plurality of heatable dryer cylinders which come into contact with the paper web;

b) in a first, initial region of the dryer section, at least one of the dryer groups is configured as a single-felt dryer group in which a single endless felt and the paper web travel together meandering alternately over the dryer cylinders and over guide or transfer rolls;

c) in a second region, at an end of the dryer section, directly or indirectly downstream of the single-felt dryer group, there is at least one double-felt dryer group in which the paper web travels meandering alternately over upper and lower drying cylinders, with an open draw of paper web being formed between the upper and lower cylinders;

d) the at least one single-felt dryer group has an automatic ropeless tail guide device for threading a tail through the single-tier dryer groups; and e) an automatic ropeless tail guide device associated with the at least one double-felt dryer group for threading the tail therethrough, said at least one double-felt dryer group being free of any rope-based tail guiding devices.

2. A dryer section according to claim 1, wherein the at least one single-felt dryer group is so dimensioned that it comprises at least about 30 to 60% of the drying surface of the entire dryer section.

3. A dryer section according to claim 1, wherein the automatic tail guide device includes a blow device which guides a tip of the tail between the upper and lower cylinders.

4. A dryer section according to claim 3, wherein a wall portion of a scraper support member extends in an edge zone of the tail substantially parallel to a free path of travel of the web and is effective to expel a jet of blast air substantially in the direction of travel of the paper web.

5. A dryer section according to claim 4, wherein first and second wall portions of a scraper member extend in the tail edge zone on both sides of an open draw of the paper web substantially parallel to the open draw of the paper web, at least one of the two wall portions expelling a jet of blow air substantially in the direction of travel of the web.

6. A dryer section according to claim 1, wherein in the first region a part of the tail guide device is disconnectable so that the tail arriving thereat is temporarily held up; and including at the first region devices for further conducting and for transverse cutting of a further tail.

7. A dryer section according to claim 1, wherein the at least one single-felt dryer group is top-felted.

8. A dryer section according to claim 7, wherein a first cylinder of the double-felt dryer group is a bottom cylinder.

9. A dryer section according to claim 8, wherein a substantially linear path of travel of the paper web is provided from a last cylinder of the single-felt dryer group to a first cylinder of the double-felt dryer group.

10. A dryer section according to claim 9, wherein the path of travel of the web contacts a felt guide roll lies directly in front of the first cylinder.

11. A dryer section according to claim 7, wherein a first cylinder of the double-felt dryer group is a top cylinder, a top felt (OF) of the double-felt dryer group contacting a last cylinder of the single-felt dryer group in front of the first top cylinder and traveling together with the paper web over a guide suction roll to the first top cylinder.

12. A dryer section according to claim 1, wherein the at least one single-felt dryer group is bottom-felted so that the top side of the web contacts the cylinders.

13. A dryer section according to claim 12, wherein the first cylinder of the double-felt dryer group is a bottom cylinder.

14. A dryer section according to claim 1, wherein several single-felt dryer groups are present, all of which are top-felted.

15. A dryer section according to claim 1, wherein several single-felt dryer groups are present, at least the first of which is top-felted and at least one of which is bottom-felted.

16. A dryer section according to claim 1, wherein the cylinders of each single-felt dryer group are arranged in a substantially horizontal row of cylinders.

17. A dryer section according to claim 1, wherein at least several of the cylinders of the single-felt dryer groups are arranged in several rows inclined to the vertical, rearward inclined and forward inclined rows alternately following each other.

18. A dryer section according to claim 17, wherein a V-shaped double row is formed by two bottom-felted dryer groups, between the lowermost cylinders of which a gap is openable to enable removal of paper broke.

19. A dryer section according to claim 1, wherein at least some of the guide suction rolls each have a rotatable and grooved roll body and an external suction box.

20. A dryer section according to claim 19, wherein the external suction box has close to preceding cylinders a deflection ledge deflecting an air layer brought along by the felt.

21. A dryer section according to claim 7, wherein rotation axes of the cylinders of the single-felt dryer group lie at least approximately in the same horizontal plane (E1) as the axes of the upper cylinders of the at least one double-felt dryer group.

22. A dryer section according to claim 7, wherein rotation axes of the cylinders of the single-felt dryer group lie in a horizontal plane (E1) which is arranged above rotation axes of the upper cylinders of the at least one double-felt dryer group.

23. A dryer section according to claim 7, wherein the axes of the transfer rolls of the single-felt dryer group lie approximately in the same horizontal plane as the axes of the lower cylinders of the at least one double-felt dryer group.

24. A dryer section according to claim 1, wherein, in front of a first cylinder of the double-felt dryer group the felt (OF) traveling over the first cylinder travels at a small distance (a)

away from and parallel to a felt (F) of a preceding dryer group.

25. A dryer section according to claim 1, wherein the dryer section is so configured that the paper web transfers into the second region including the at least one double-felt dryer group at a place where only 40–70% of the entire drying surface of the entire dryer section remains to be traversed by the paper web.

26. A dryer section according to claim 10, wherein the felt guide roll is a suction roll.

27. The dryer section of claim 21, including uniform stands for the cylinders.

28. A dryer section according to claim 21, wherein the axes of the deflection suction rolls of the single-felt dryer group lie at least approximately in the same horizontal plane as the axes of the lower cylinders of the at least one double-felt dryer group.

29. A dryer section according to claim 22, wherein, in front of a first cylinder of the double-felt dryer group the felt (OF) traveling over the first cylinder travels at a small distance away (a), parallel to a felt (F) of a preceding dryer group.

30. A dryer section according to claim 4, wherein a first and second wall portions of a guide plate extend in the tail edge zone on both sides of an open draw of the paper web substantially parallel to the open draw of the paper, at least one of the two wall portions expelling a jet of blow air substantially in the direction of travel of the web.

31. A dryer section according to claim 1, wherein at least some of the guide suction rolls each have a rotatable and perforated roll body and an external suction box.

32. The dryer section of claim 1, wherein said second region, at the end of the dryer section, consists of a first double-felt dryer group and a second double-felt dryer group.

33. A method for threading a tail of a machine-wide travelling paper web, into a dryer section for drying said web by means of a plurality of successively arranged dryer groups, each group including a plurality of heatable dryer cylinders which come into contact with the paper web, the method comprising:

conducting said tail automatically, by means of a ropeless tail guide means through a first, initial region of the dryer section, wherein at least one of the dryer groups is configured as a single-felt dryer group in which a single endless felt and the paper web travel together meandering alternately over the dryer cylinders and over transfer rolls, and through a second region at an end of the dryer section, downstream of the single-felt dryer group wherein is provided at least one double-felt dryer group in which the paper web travels meandering alternately over upper and lower drying cylinders, with an open draw of paper web being formed between the upper and lower cylinders.

34. The method of claim 33, wherein the at least one double-felt dryer group is provided directly downstream of the single-felt dryer group.

35. A method for drying a paper web in a drying section, comprising the steps of:

a) providing a plurality of successively arranged dryer groups, each group including a plurality of heatable dryer cylinders which come into contact with the paper web;

b) conducting the paper web through a first, initial region of the dryer section, in which at least one of the dryer groups is configured as a single-felt dryer group in which a single endless felt and the paper web travel together meandering alternately over the dryer cylinders and over transfer rolls;

c) thereafter conducting the paper web through a second region, at an end of the dryer section, downstream of the single-felt dryer group which second region includes at least one double-felt dryer group in which the paper web travels meandering alternately over upper and lower drying cylinders, with an open draw of paper web being formed between the upper and lower cylinders;

d) threading a tail of the paper web through the at least one single-felt dryer group with an automatic ropeless tail guide device; and e) threading the tail with a further automatic ropeless tail guide device through the at least one double-felt dryer group.

36. The method of claim 35, wherein the at least one double-felt dryer group is provided directly downstream of the single-felt dryer group.

37. The method of claim 35, wherein the second region, at the end of the dryer section, consists of a first double-felt dryer group and a second double-felt dryer group, and the method includes the step of threading the tail with the further automatic ropeless tail guide device through the first double-felt dryer group and through the second double-felt dryer group.

38. A method according to claim 35, including providing a sufficient number of the dryer cylinders in the at least one single-felt dryer group so that the at least one single-felt dryer group comprises at least about 30–65% of the drying surface of the entire drying section.

39. A method according to claim 38, comprising drying a newsprint type paper web, and wherein the at least one single-tier dryer group comprises about 41–61% of the drying surface of the entire drying section.

40. A method according to the claim 39, wherein the at least one single-felt dryer group comprises about 50% of the drying surface of the entire drying section.

41. A method according to claim 38, comprising drying a woodfree type paper web and wherein the at least one single-tier dryer group comprises about 44–64% of the drying surface of the entire drying section.

42. A method according to the claim 41, wherein the at least one single-felt dryer group comprises about 54% of the drying surface of the entire drying section.

43. A method according to claim 38, comprising drying a supercalendered type paper web and wherein the at least one single-tier dryer group comprises about 35–57% of the drying surface of the entire drying section.

44. A method according to the claim 43, wherein the at least one single-felt dryer group comprises about 47% of the drying surface of the entire drying section.

45. A method according to claim 38, comprising drying a base paper for lightweight coated type paper web and wherein the at least one single-tier dryer group comprises about 40–60% of the drying surface of the entire drying section.

46. A method according to the claim 45, wherein the at least one single-felt dryer group comprises about 50% of the drying surface of the entire drying section.

47. A method according to claim 38, comprising drying a copy type paper web and wherein the at least one single-tier dryer group comprises about 45–65% of the drying surface of the entire drying section.

48. A method according to the claim 47, wherein the at least one single-felt dryer group comprises about 55% of the drying surface of the entire drying section.

49. A method according to claim 38, wherein the drying section is run at a speed of between 1,000 to 2,000 meters per minute.

50. A dryer section according to claim 1, wherein:

the dryer section includes a trailing single-tier dryer group which is located directly preceding a leading double-tier dryer group and the trailing single-tier dryer group has its heatable dryer cylinders in a plane II and includes a plurality of vacuum rolls whose axes of rotation are disposed in a plane III;

the leading double-tier dryer group has top cylinders disposed in a plane IV and bottom cylinders disposed in a plane V;

the leading double-tier dryer group has a plurality of upper felt rolls associated with the top cylinders in a plane VI and a plurality of bottom felt rolls associated with the bottom cylinders in a plane VII; and wherein both planes II and III are disposed between the planes IV and V.

51. The dryer section of claim 50, wherein the planes VI and VII are disposed between the planes II and III.

52. The dryer section of claim 50, wherein the plane III is disposed below the plane II.

53. The dryer section of claim 50, wherein the plane III is disposed above the plane II.

54. The dryer section of claim 50, further comprising a trailing felt roll associated with the trailing single-tier dryer group and a leading felt roll associated with the bottom cylinders of the double-tier dryer group, the trailing and leading felt rolls being disposed in the same plane VIII, and wherein the plane VIII is between the planes VI and VII.

55. The dryer section of claim 50, including a single-tier felt for the trailing single-tier group and wherein the single-tier felt extends tangent to a bare surface of a leading cylinder of top cylinders of the double-tier group.

56. The dryer section of claim 50, wherein the leading double-tier group includes an upper felt and the upper felt extends tangent to a trailing cylinder of the trailing single-tier dryer group.

57. The dryer section according to claim 56, wherein the upper felt engages a vacuum roll directly immediately after engaging the trailing cylinder of the single-tier group.

58. The dryer section of claim 50, wherein the paper web travels along a generally downwardly directed path from the trailing cylinder of the trailing single-tier to a bottom leading cylinder of the adjacent double-tier group, the bottom cylinders including a leading vacuum roll, the leading vacuum roll engaging and exerting a vacuum force on the paper web on its path between the trailing dryer and the leading dryer.

59. A dryer section according to claim 50, the adjacent double-tier dryer including a bottom felt, the bottom felt extending tangent to a trailing cylinder of the trailing single-tier dryer group.

60. The dryer section of claim 59, including a leading vacuum roll which is felted by the bottom felt of adjacent double-tier group, the bottom felt engaging the leading vacuum roll immediately after making the tangent contact with the trailing cylinder.

61. The dryer section of claim 50, wherein the adjacent double-tier dryer group includes an upper leading dryer cylinder, wherein the paper web path is from the trailing cylinder of the single group to the upper leading cylinder of the double-tier group, and including a vacuum roll which is felted together with the upper leading cylinder and which leads the upper leading dryer cylinder.

62. The dryer section of claim 50, including a single-tier felt associated with the trailing single-tier dryer group, the single-tier felt extending tangent to a leading bottom cylinder of the adjacent double-tier group.

63. A dryer section of claim 50, wherein the heatable dryer cylinders in the adjacent double-tier dryer group are smaller in size than the corresponding heatable dryer cylinders of the trailing single-tier dryer group.

64. The dryer section of claim 50, wherein the paper web has a width along a cross machine direction and wherein the ratio of the number of the heatable dryer cylinders in the at least one single-tier dryer group to the number of heatable dryer cylinders in the at least one double-tier dryer group is optimized to render a greater portion of the width of the paper web in salable condition.

65. A dryer section according to claim 50, wherein the at least one double-tier dryer group has a plurality of perforated felt rolls associated with the cylinders, and including means for applying a vacuum to the perforated felt rolls.

66. A dryer section according to claim 50, wherein the double-tier dryer group has a plurality of bottom felt rolls associated with the bottom cylinders and wherein the bottom felt rolls are perforated, and including means for applying a vacuum to the perforated felt rolls to assist the removal of broke during a paper web break.

67. A dryer section according to claim 50, including means for controlling the humidity in pockets associated with the double-tier dryer groups.

68. The dryer section of claim 50, including air nozzle means at transfer regions between the single-tier and the double-tier groups for assisting in the transfer of the paper web from the single-tier to the double-tier groups during threading of a tail.

69. A dryer section for drying a paper web, comprising:

a plurality of successively arranged dryer groups, each group including a plurality of heatable dryer cylinders which come into contact with the paper web;

in a first, initial region of the dryer section, a plurality of single-tier dryer groups including a plurality of top felted single-tier dryer groups and at least one bottom felted single-tier dryer group, the heatable dryer cylinders of the top felted single-tier dryer groups being disposed in a first plane and the heatable dryer cylinders of the bottom felted single-tier dryer groups being disposed in a second plane;

in a second region at an end of the dryer section, downstream of the single-tier dryer groups, there is provided at least one double-tier dryer group including a first row of the heatable dryer cylinders disposed in a third plane and a second row of the heatable dryer cylinders disposed in a fourth plane;

the first and the third planes extending horizontally and being co-planar, the second and the fourth planes extending horizontally and being co-planar.

70. The dryer section of claim 69, in which the at least one double-tier dryer group in the second region consists of a first double-tier dryer group and a second double-tier dryer group.

* * * * *